US007445330B2

(12) United States Patent
Kudoh et al.

(10) Patent No.: US 7,445,330 B2
(45) Date of Patent: Nov. 4, 2008

(54) IMAGE FORMING APPARATUS

(75) Inventors: Taku Kudoh, Sagamihara (JP); Manabu Nonaka, Chigasaki (JP); Yasuhiro Kawashima, Atsugi (JP)

(73) Assignee: Ricoh Company, Ltd., Tokyo (JP)

( * ) Notice: Subject to any disclaimer, the term of this patent is extended or adjusted under 35 U.S.C. 154(b) by 384 days.

(21) Appl. No.: 10/943,249

(22) Filed: Sep. 17, 2004

(65) Prior Publication Data

US 2005/0104927 A1 May 19, 2005

(30) Foreign Application Priority Data

Sep. 19, 2003 (JP) ..... 2003-328769
Sep. 8, 2004 (JP) ..... 2004-261326

(51) Int. Cl.
*B41J 29/13* (2006.01)
*B41J 23/00* (2006.01)

(52) U.S. Cl. ..... 347/108; 347/37

(58) Field of Classification Search ..... 347/2, 347/37, 108; 399/110, 111, 124
See application file for complete search history.

(56) References Cited

U.S. PATENT DOCUMENTS

| | | | | |
|---|---|---|---|---|
| 3,750,794 | A | | 8/1973 | Griggs, Jr. |
| 4,473,312 | A | | 9/1984 | Forschner |
| 4,708,486 | A | * | 11/1987 | Watanabe ..... 358/296 |
| 4,708,502 | A | | 11/1987 | Murakami |
| 5,096,316 | A | | 3/1992 | Otsuka et al. |
| 5,493,365 | A | | 2/1996 | Matsui et al. |
| 5,497,250 | A | | 3/1996 | Kawashima |
| 5,497,986 | A | | 3/1996 | Kudo |
| 5,504,590 | A | | 4/1996 | Kawada et al. |
| 5,610,725 | A | | 3/1997 | Kawada et al. |
| 5,764,371 | A | | 6/1998 | Kawashima et al. |
| 5,884,860 | A | | 3/1999 | Ishikawa et al. |
| 5,961,226 | A | | 10/1999 | Nishida |
| 5,971,525 | A | | 10/1999 | Inoue et al. |
| 5,986,775 | A | | 11/1999 | Yoshimizu |
| 5,988,787 | A | | 11/1999 | Watanabe et al. |
| 5,996,990 | A | | 12/1999 | Kawashima |
| 6,000,690 | A | | 12/1999 | Kudoh |
| 6,005,687 | A | | 12/1999 | Kawashima et al. |
| 6,067,170 | A | | 5/2000 | Kawashima et al. |
| 6,079,708 | A | | 6/2000 | Fujita |
| 6,128,107 | A | | 10/2000 | Kawashima |
| 6,147,781 | A | | 11/2000 | Tanaka et al. |
| 6,153,832 | A | | 11/2000 | Gaarder |

(Continued)

FOREIGN PATENT DOCUMENTS

EP 0 372 997 A2 6/1990

(Continued)

*Primary Examiner*—Stephen D Meier
*Assistant Examiner*—Geoffrey Mruk
(74) *Attorney, Agent, or Firm*—Oblon, Spivak, McClelland, Maier & Neustadt, P.C.

(57) ABSTRACT

An image forming apparatus includes a printing unit configured to form an image on a recording medium, and a guide device configured to guide the printing unit to be drawn in a direction perpendicular to a recording medium conveying direction in which the recording medium is conveyed. Thus, because the printing unit can be drawn out from the main body of the apparatus, maintenance work to the printing unit can be easily performed in a state that the printing unit has been drawn out from the apparatus.

41 Claims, 15 Drawing Sheets

U.S. PATENT DOCUMENTS

| | | | | |
|---|---|---|---|---|
| 6,178,274 | B1 | 1/2001 | Youda et al. | |
| 6,182,964 | B1 | 2/2001 | Tanaka et al. | |
| 6,311,973 | B1 | 11/2001 | Tanaka et al. | |
| 6,349,155 | B1 | 2/2002 | Youda et al. | |
| 6,400,472 | B1 | 6/2002 | Yoshimizu | |
| 6,406,118 | B1 | 6/2002 | Aoki et al. | |
| 7,147,102 | B2 * | 12/2006 | Silverbrook et al. | 206/225 |
| 2003/0155702 | A1 | 8/2003 | Togashi et al. | |

FOREIGN PATENT DOCUMENTS

| | | | |
|---|---|---|---|
| EP | 0 765 761 | A1 | 4/1997 |
| JP | 03-347641 | * | 6/1993 |
| JP | 05-155011 | | 6/1993 |
| JP | 5-155011 | | 6/1993 |
| JP | 3167486 | | 8/1994 |
| JP | 06-297722 | | 10/1994 |
| JP | 6-297722 | | 10/1994 |
| JP | 2002-506758 | | 3/2002 |
| JP | 2002-361897 | * | 12/2002 |
| JP | 2004-142365 | | 5/2004 |
| JP | 2004-188682 | | 7/2004 |

* cited by examiner

IMAGE FORMING APPARATUS

CROSS-REFERENCE TO RELATED APPLICATIONS

The present application claims priority and contains subject matter related to Japanese Patent Applications No. 2003-328769 and No. 2004-261326 filed in the Japanese Patent Office on Sep. 19, 2003 and Sep. 8, 2004, respectively, and the entire contents of each of which are hereby incorporated herein by reference.

BACKGROUND OF THE INVENTION

1. Field of the Invention

The present invention relates generally to an image forming apparatus, and in particular relates to an image forming apparatus in which a printing part is drawn toward the front side of the apparatus so that the printing part can be easily replaced.

2. Discussion of the Background

An image forming apparatus using an ink jet process is relatively simple in configuration when compared with an image forming apparatus performing optical writing by scanning a laser beam. Generally each component of a printing part of the apparatus is mounted to a frame of the apparatus. When repair is necessary to the printing part, the apparatus itself is replaced or each component of the printing part in need of repair is replaced.

Japanese Patent Application Publication No. 2002-506758 describes a hard copy apparatus as an image forming apparatus in which each component of a printing part is replaceable. The hard copy apparatus is configured in such a way that it includes: a writing engine device as the printing part, an ink jet printing module which transfers ink to a print medium, a service module which maintains ink jet printing functional integrity of the writing engine device, at least one ink, at least one ink containing module which contains a predetermined quantity of said ink, a delivery module which delivers said ink from said ink containing module to said ink jet printing module, and an electrical module which connects power and control to said writing engine device all housed in a housing module in respective operational configurations as selectively replaceable units within the hard copy apparatus.

When repair is necessary to a printing part in an image forming apparatus using an ink jet process (ink jet printing apparatus), replacing each component of the printing part in need of repair is inefficient in working efficiency because liquid ink is used and thereby careful attention is needed. That is, in the ink jet printing apparatus, because ink needs to be supplied to an ink jet printing module including printing heads, a mechanism to supply the ink to the ink jet printing module, e.g., ink supplying tubes or ink supplying conduits, are connected with the ink jet printing module. When replacing the inkjet printing module, for example, after disconnecting such ink supplying tubes or conduits from the ink jet printing module, the ink jet printing module is detached from the apparatus, and when attaching the ink jet printing module to the apparatus, the ink supplying tubes or conduits must be attached to the ink jet printing module again. Thus, the work of replacing the ink jet printing module takes a relatively long time because it involves detachment of ink supplying tubes or conduits.

Further, when replacing the ink jet printing module, because of a possibility of ink leakage, ink in the ink jet printing head (in a sub-tank) must be removed, and in performing the replacing work, attention must be paid to a difference in ink level between the sub-tank and a main tank. If ink leaks, the inside of the apparatus might be soiled, or the floor of the customer's premises where the apparatus is placed might be soiled. In order to avoid such ink leakage, the work must be performed very carefully, which further lengthens the time of replacing the ink jet printing module. If the inside of the apparatus or the floor of the customer's premises is soiled, it takes time and trouble to clean the inside of the apparatus or the floor; thereby the working efficiency is further decreased.

In relation to the above-described problem, Japanese Patent Publication No. 3167486 describes an ink jet printing apparatus as an image forming apparatus in which a printing part is replaceable as an integrated unit. The ink jet printing apparatus includes an ink jet printing head opposing and moving relative to a printing sheet, a fixed ink storage device as a supply source supplying ink to the ink jet printing head, an ink supplying tube supplying the ink in the fixed ink storage device to the ink jet printing head, and a connecting cable connecting a drive circuit and an electrode of the ink jet printing head with each other. The ink jet printing head and its driving device, the fixed ink storage device, the ink supplying tube, and the connecting cable and its connecting terminal are mounted to a support member to be configured as an integrated replaceable unit, and the support member is configured to be detachably attached to the main body of the apparatus. Specifically, the replaceable unit including the ink jet printing head, the fixed ink storage device, etc. is attached to an upper surface of the main body of the apparatus from above through the intermediary of an attaching axis, and is fixed by a hook at a side surface of the main body. Accordingly, in this case, the ink jet printing head, the ink supplying mechanism including the fixed ink storage device, and the connecting cable and its terminal can be replaced as an integrated unit. However, the replacing work to the unit must be performed from above, so that an upper space of the main body must be open. Further, a sheet feeding and conveying mechanism including a platen roller and its driving system and a drive source of the ink jet printing head are provided at the side of the main body of the apparatus, separately from the replaceable unit. Thus, the ink jet printing head is structurally independent from the drive source of the ink jet printing head and the sheet feeding and conveying mechanism. When the printing part including the ink jet printing head is replaced, it is hard to keep a distance between the ink jet printing head and the sheet feeding and conveying mechanism and to keep their relative positions the same as before replacing the printing part. Thus, there is a limit in printing accuracy that can be obtained after replacement of the printing part.

Further, when detaching the printing part from the main body of the apparatus, as described also in JP publication NO. 3167486, electrical systems connecting the printing part and the main body must be also detached. In an ink jet printing apparatus, because an ink jet printing head includes many nozzles and these nozzles must be controlled, the number of connecting pins for connecting the printing part and a control board of the main body reaches 100 to 200. When the number of connecting pins is large, a drawer-type connector is ideal. However, a relatively large power is needed in pulling and inserting hundreds of pins, so that under present circumstances, a connector having hundreds of pins is not available, and generally, plural connectors are used.

In an ink jet printing apparatus, a control part of the main body of the apparatus is often arranged at the rear side of the main body of the apparatus because of a need to perform clearance of a jammed sheet and replacement of an ink cartridge from the front side of the apparatus. Therefore, when the control part of the main body of the apparatus is arranged at the rear side of the main body and connectors for connecting electrical systems connecting a printing part of the apparatus and the control part of the main body are arranged at the front side of the apparatus, connecting cables must be wired from the rear side to the front side of the apparatus. This results in the connecting cables connecting the printing part and the control part of the main body being made longer, which increases a possibility of picking-up noise, and thereby a problem may be caused in printing control. When the connectors are arranged at the rear side of the apparatus, the apparatus itself must be first drawn to this side to disconnect the connectors, which is inconvenient.

SUMMARY OF THE INVENTION

The present invention has been made in view of the above-discussed and other problems and addresses the above-discussed and other problems.

Preferred embodiments of the present invention provide a novel image forming apparatus that allows maintenance work to be easily performed without requiring a sufficient space above the apparatus.

The preferred embodiments of the present invention further provide a novel image forming apparatus that allows a printing part to be integrally replaced without requiring a sufficient space above the apparatus.

The preferred embodiments of the present invention further provide a novel image forming apparatus in which a relative positional relation between a printing part and a sheet conveying mechanism can be kept substantially constant even when the printing part has been replaced and thereby superior printing accuracy can be obtained.

The preferred embodiments of the present invention further provide a novel image forming apparatus that allows, when replacing a printing part, an electrical system connecting the printing part and the main body of the apparatus can be easily detached and attached and that is thereby superior in workability in replacing the printing part.

According to a preferred embodiment of the present invention, an image forming apparatus includes a printing part configured to form an image on a recording medium, and a guide device configured to guide the printing part to be drawn in a direction perpendicular to a recording medium conveying direction in which the recording medium is conveyed. Thus, because the printing part can be drawn out from the main body of the apparatus, maintenance work to the printing part can be easily performed in a state that the printing part has been drawn out from the main body of the apparatus.

In the image forming apparatus, the guide device may include a guide member provided to a main body of the apparatus and extending in the direction perpendicular to the recording medium conveying direction, and a guided member provided to the printing part and configured to be guided by the guide member. Further, the guided member provided to the printing part may include a protruding member, and in this case the guide member provided to the main body supports the protruding member so as to be movable in the direction perpendicular to the recording medium conveying direction.

Further, in the image forming apparatus, the guide device may include a floor surface of an accommodating part of a main body of the apparatus accommodating the printing part.

Furthermore, in the image forming apparatus, the guide device may support the printing part so as to be detachable from the main body. Thus, because the printing part can be drawn out in the direction perpendicular to the recording medium conveying direction to be detached from the main body of the apparatus, the printing part can be easily replaced without requiring space above the apparatus.

Still further, in the image forming apparatus, the printing part may include a printing mechanism including a carriage mounting an ink jet printing head and configured to move the carriage in a main scanning direction. Further, the printing mechanism may include a control circuit to control movement of the carriage in the main scanning direction.

Still further, in the image forming apparatus, the printing part may include a sub-scanning conveying mechanism to convey the recording medium in a sub-scanning direction at a part of the printing part where the image is formed on the recording medium. The sub-scanning conveying mechanism may include a conveying roller, a platen, and a drive source driving the conveying roller, or alternatively, may include a conveying roller, a conveying belt, and a drive source driving at least either of the conveying roller and the conveying belt. The sub-scanning conveying mechanism may further include a control circuit to control conveying the recording medium in the sub-scanning direction.

Thus, in the image forming apparatus, the printing part may include a printing mechanism including a carriage mounting an ink jet printing head and configured to move the carriage in a main scanning direction, and a sub-scanning conveying mechanism to convey the recording medium in a sub-scanning direction at a part of the printing part where the image is formed on the recording medium. Thereby, a relative positional relation between the printing mechanism, including the carriage mounting the ink jet printing head and configured to move the carriage in the main scanning direction, and the sub-scanning conveying mechanism, conveying the recording medium in the sub-scanning direction at a part of the printing part where the image is formed on the recording medium, can be kept substantially constant even when the printing part has been replaced, so that superior printing accuracy can be obtained.

Still further, in the image forming apparatus, the printing part may include a connection device configured to connect the printing mechanism and/or the sub-scanning conveying mechanism of the printing part with a control part of the main body of the apparatus. The connection device is arranged at a part of the printing part, which is exposed when, in a state that the printing part is accommodated in the main body of the apparatus, a side cover of the apparatus has been opened. Thus, because the connection device connecting the printing mechanism and/or the sub-scanning conveying mechanism of the printing part with a control part of the main body of the apparatus is arranged at a part of the printing part that is exposed when in a state that the printing part is accommodated in the main body of the apparatus and a side cover of the apparatus has been opened detaching and attaching the printing part from and to the main body of the apparatus and connection and disconnection of electrical systems connecting the printing part and the main body of the apparatus can be easily performed.

Still further, the image forming apparatus may include an ink tank configured to supply ink to the printing part and to be drawn integrally with the printing part when the printing part is drawn.

Still further, in the image forming apparatus, the printing part may include a handhold. The handhold may include a belt-like member extending along a member of the printing part with a tip end thereof detachably fastened to the member and configured such that the tip end thereof can be detached from the member and after the tip end thereof has been detached from the member and the belt-like member has been bent, can be fastened to another member of the printing part so that the belt-like member can be grasped with fingers.

Still further, the image forming apparatus may include an image reading part configured to optically read an original document and to convert image information of the original document to an electrical signal, and an image forming part including the printing part. In this case, the image reading part is provided above the image forming part integrally with the image forming part. Further, a discharging tray onto which the recording medium on which the image has been formed is discharged is provided between the image reading part and the image forming part.

According to another preferred embodiment of the present invention, an image forming apparatus includes a printing part detachable from a main body of the apparatus and configured to form an image on a recording medium, and a connection device arranged at a part of the printing part, that is exposed when, in a state that the printing part is accommodated in the main body of the apparatus, a side cover of the apparatus has been opened and configured to connect the printing part with a control part of the main body of the apparatus.

BRIEF DESCRIPTION OF THE DRAWINGS

A more complete appreciation of the present invention and many of the attended advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
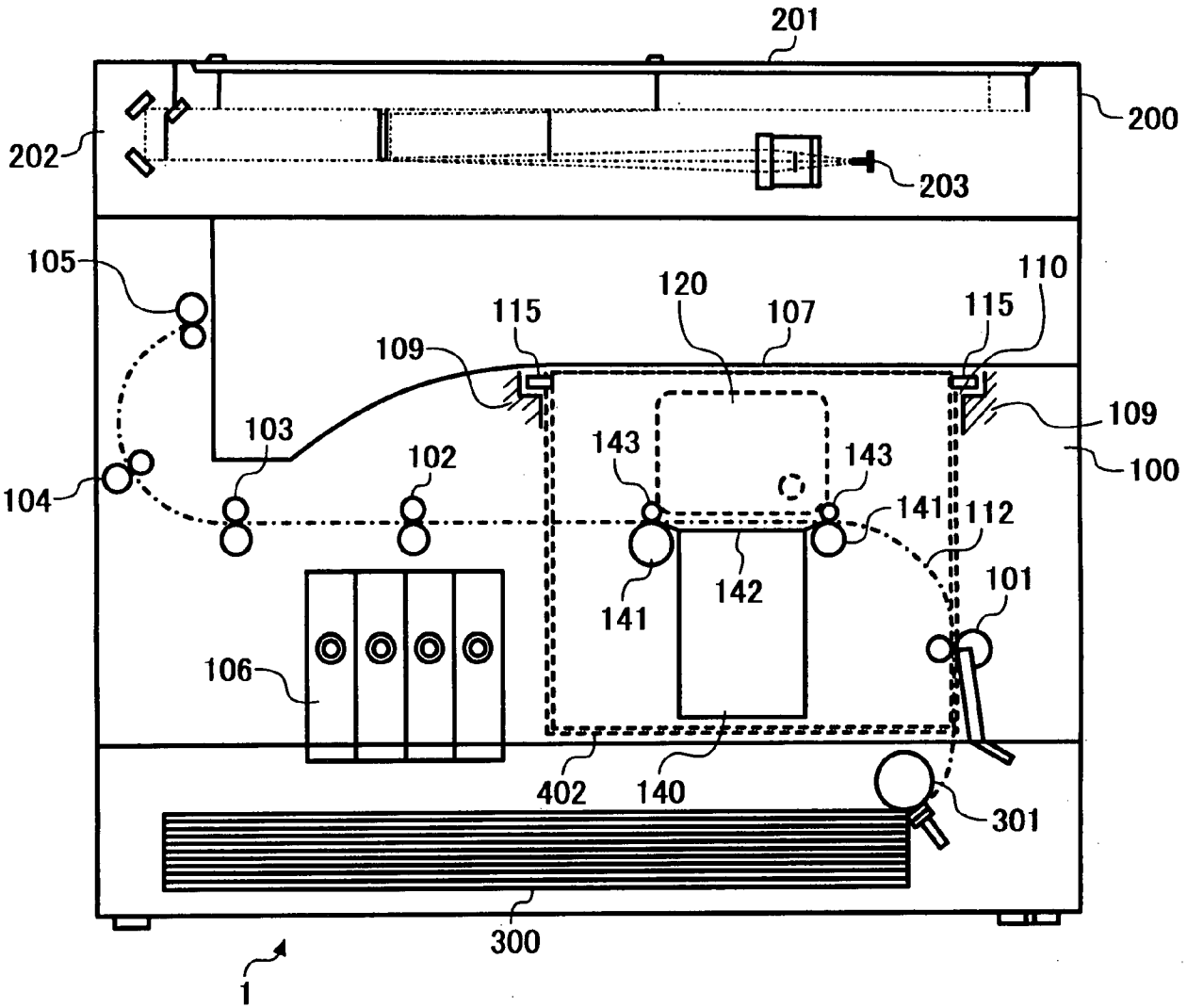
FIG. 1 is a diagram schematically illustrating a construction of a copying apparatus using an ink jet printing method as an image forming apparatus according to a preferred embodiment of the present invention.

Referring now to the drawings, wherein like reference numerals designate identical or corresponding parts throughout the several views, preferred embodiments of the present invention are described.

FIG. 1 is a diagram schematically illustrating a construction of a copying apparatus 1 using an ink jet printing method as an image forming apparatus according to a preferred embodiment of the present invention, viewed from a direction perpendicular to a sheet conveying direction (i.e., the main scanning direction). The copying apparatus 1 includes an image forming part 100, an image reading part (scanner) 200, and a sheet feeding part 300. The image forming part 100 is arranged above the sheet feeding part 300, and the image reading part 200 is arranged above the image forming part 100.

Stacked recording sheets (recording media) are accommodated in the sheet feeding part 300 and are fed one by one from the uppermost one toward the image forming part 100 with a separation and conveying part 301 including a pick-up roller.

The image reading part 200 is configured to read an original document placed on a contact glass 201 with a CCD (charge coupled device) 203 by moving a reading optical system 202.

The image forming part 100 includes conveying rollers 101, 102 and 103, a reversing roller 104, a discharging roller 105, a printing unit 110, and an ink tank 106. The printing unit 110 includes, as described later, a printing mechanism part 120, a sub-scanning conveying mechanism part 140, a maintenance mechanism part 150, and a blank printing mechanism part 160.

In the copying apparatus 1 configured as described above, a recording sheet separated at the separating and conveying part 301 of the sheet feeding part 300 is guided to the printing unit 110 by the conveying roller 101 through a portion of a conveying path 112 conveying the recording sheet to a discharging tray 107 provided to an upper surface of a housing 402 of the image forming part 100. The recording sheet is conveyed by the sub-scanning conveying mechanism part 140 a predetermined conveying distance set according to a printing width of ink jet printing heads (described later) in the sub-scanning direction and a predetermined number of lines are printed on the recording sheet. By repeating this operation, image data obtained at the image reading part 200 is printed on the recording sheet, thereby forming an image on the recording sheet. The recording sheet on which the image has been formed is conveyed with the conveying rollers 102 and 103 to the reversing roller 104, where the recording sheet is reversed in the conveying direction. The recording sheet is then discharged with a discharging roller 105 onto the discharging tray 107.

As illustrated in FIG. 1, the image reading part 200 is arranged above the image forming part 100 sandwiching the discharging tray 107 with the image forming part 100, so that a space for replacing the printing unit 110 cannot be obtained above the printing unit 110.

Figure 2:
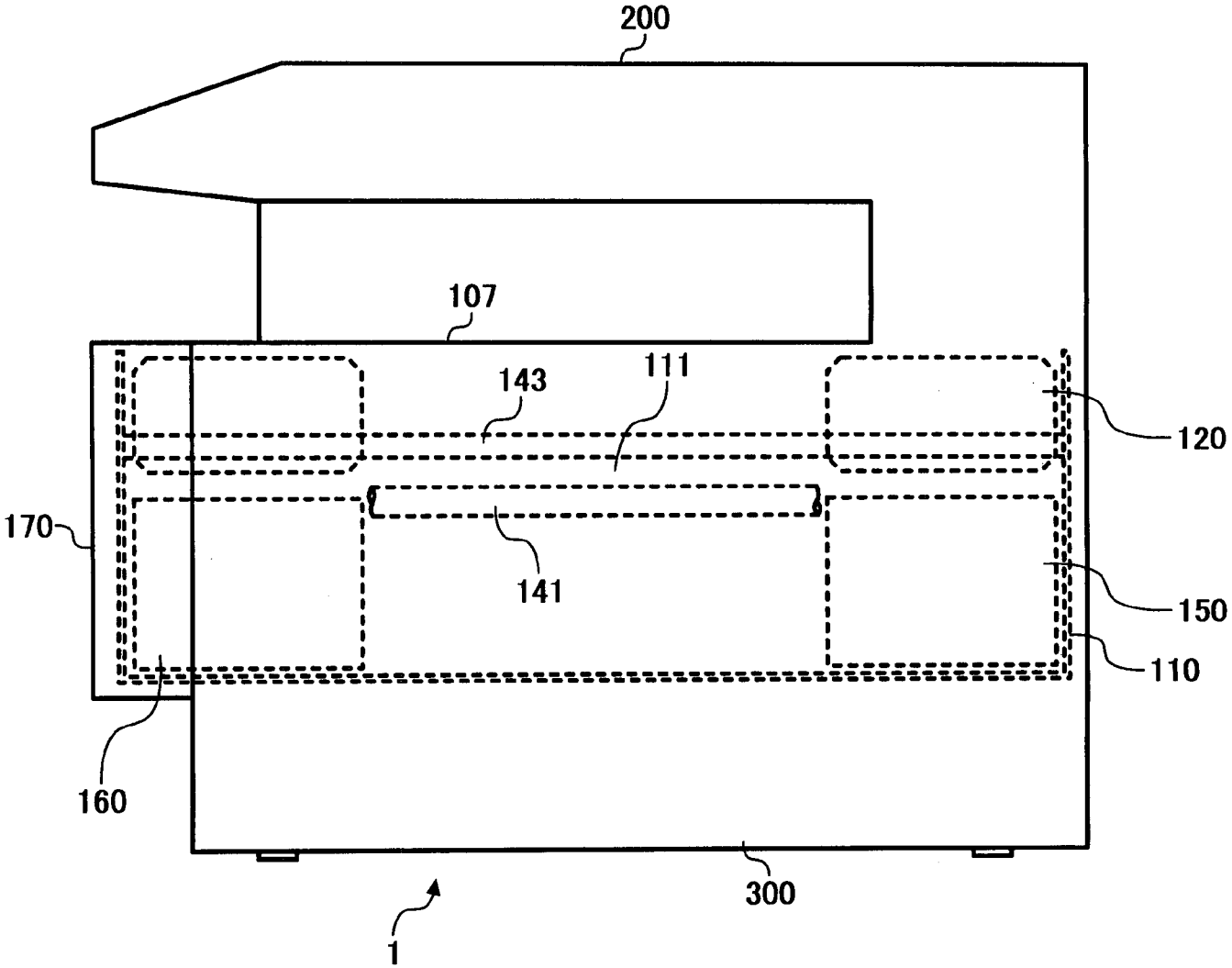
FIG. 2 is a side view of the copying apparatus illustrated in FIG. 1.
Figure 3:
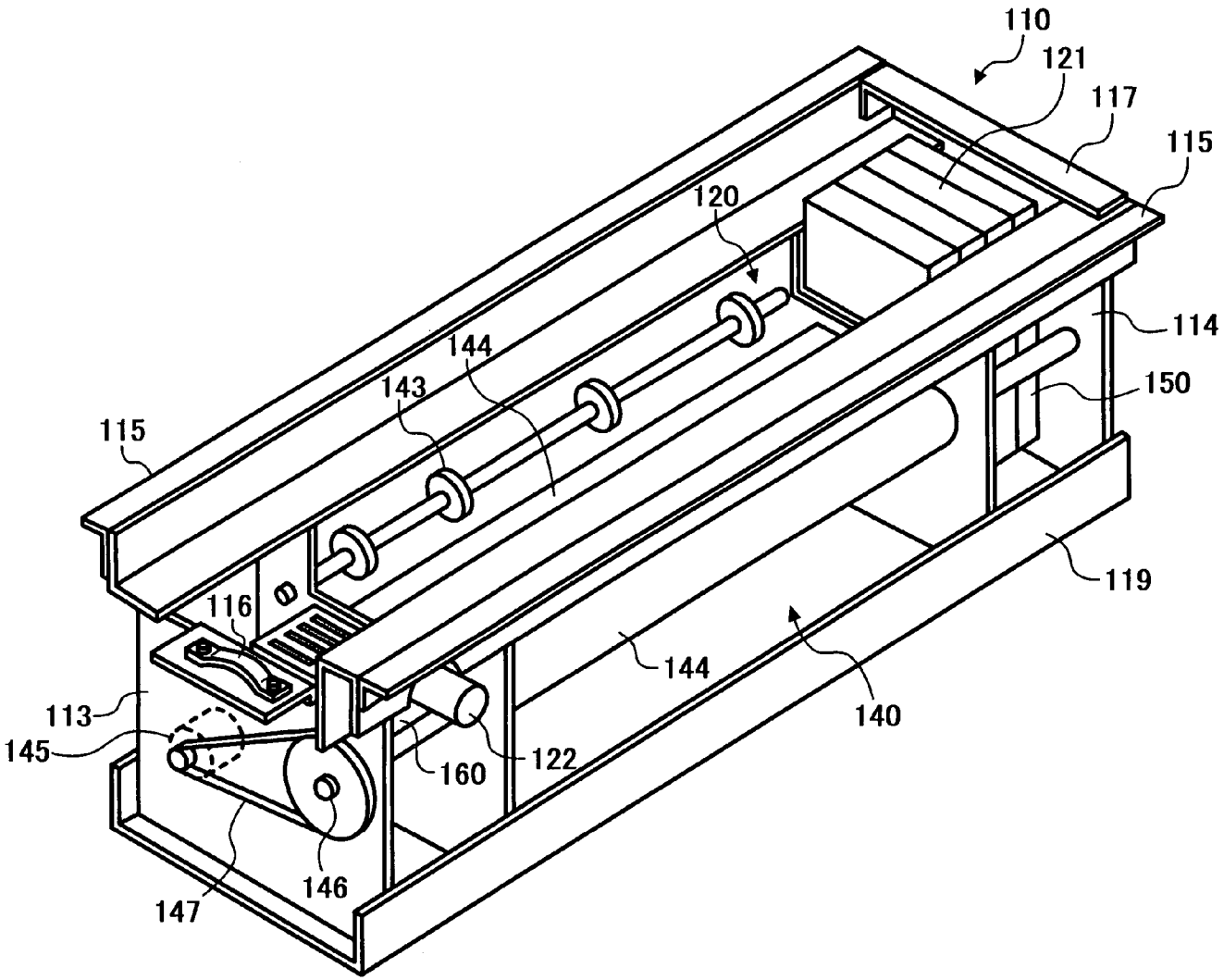
FIG. 3 is a perspective view schematically illustrating an example of a printing unit of the copying apparatus.

FIG. 2 is a right side view of the copying apparatus 1 illustrated in FIG. 1, and FIG. 3 is a perspective view schematically illustrating an exemplary construction of the printing unit 110. The printing unit 110 is configured as a unit in which the printing mechanism part 120, the sub-scanning conveying mechanism part 140, the maintenance mechanism part 150, and the blank printing mechanism part 160 are mounted, and a recording sheet conveying path 111 (a portion of the conveying path 112) is provided between the printing mechanism part 120 and the sub-scanning conveying mechanism part 140.

The maintenance mechanism part 150 includes mechanical elements necessary for maintaining the operation capability of the ink jet printing heads, such as a cap configured to prevent a nozzle of the ink jet printing head from being dried, a wiper configured to wipe a nozzle surface of the ink jet printing head to remove ink from the nozzle surface, etc., and is arranged at the side of the home position of the ink jet printing head. The blank printing mechanism part 160 is arranged at an end part at the opposite side of the home position of the ink jet printing heads in the main scanning direction to perform blank printing at the start of printing or at a predetermined timing to prevent ink clogging. The blank printing mechanism part 160 includes at its bottom part a discharged ink receiver arranged to oppose the ink jet printing heads to receive discharged ink in blank printing. A known mechanism may be used for each of the maintenance mechanism part 150 and the blank printing mechanism part 160, and therefore description thereof is omitted.

The printing mechanism part 120 includes, as illustrated in FIG. 3, a carriage 121, a pair of guide members (not shown) guiding the carriage 121 in the main scanning direction, and a main scanning motor 122 to move the carriage 121 along the pair of guide members in the main scanning direction. The carriage 121 is provided with the ink jet printing heads having discharging outlets for a predetermined number of lines at the bottom surface thereof for each of yellow (Y), magenta (M), cyan (C) and black (K) colors. Ink is provided to the carriage 121 from the ink tank 106 (illustrated in FIG. 1). The main scanning motor 122 is arranged at the side of the blank printing mechanism 160 (i.e., at the front side in a later-described drawing direction in which the printing unit 110 is drawn out), and an output end of the main scanning motor 122 is connected with the carriage 121 through the intermediary of a timing belt (not shown) so that rotation of the main scanning motor 122 is converted to a linear motion of the carriage 121, and thereby the carriage 121 is moved in the main scanning direction. One of the pair of guide members may be configured by a screw axis to be rotated by the main scanning motor 122.

The sub-scanning conveying mechanism part 140 includes, as illustrated in FIG. 1, sub-scanning rollers 141, a platen 142, and conveying rollers 143. The sub-scanning rollers 141 convey a recording sheet the predetermined conveying distance with a driving mechanism (not shown), and printing is performed with the ink jet printing heads mounted to the carriage 121 opposing the platen 142 and moving in the main scanning direction. Printing with the ink jet printing heads moving in the main scanning direction is performed each time the recording sheet is conveyed the predetermined conveying distance in the sub-scanning direction. The carriage 121 reciprocates in the main scanning direction, and printing is performed in each process of the reciprocating motion of the carriage 121 mounting the ink jet printing heads.

In the printing unit 110 illustrated in FIG. 3, a conveying belt 144 is used in the sub-scanning conveying mechanism part 140, and the dimension of a stretched portion of the conveying belt 144 in the conveying direction is set substantially the same as that of the carriage 121 in the sub-scanning direction. This is because that the printing width (i.e., the number of dots simultaneously printed in the sub-scanning direction) of the ink jet printing heads mounted to the carriage 121 is relatively large and it is necessary to maintain the flatness of the conveying belt 144 relative to the printing width. For maintaining the flatness of the conveying belt 144 relative to the printing width, an electrostatic belt that attracts the recording sheet with an electrostatic action or an attracting belt that attracts the recording sheet by making an air pressure on the belt to be negative may be used for the conveying belt 144. When the above-described configuration with the sub-scanning rollers 141 and the platen 142 is used, it is necessary to obtain a desired flatness with the platen 142.

The conveying belt 144 moves in the sub-scanning direction by rotating a belt drive axis 146 with a sub-scanning motor 145. The sub-scanning motor 145 is attached to a surface of a front side plate 113 of the printing unit 110 at the side of the blank printing mechanism part 160 (i.e., the front side plate 113 at the front side in the drawing direction described later), and drives the belt drive axis 146 through the intermediary of a timing belt 147. Further, the conveying rollers 143 are arranged at the recording sheet carrying-in and carrying-out side ends of the recording sheet conveying path 111 to oppose the sub-scanning rollers 141, and the recording sheet is conveyed from the sheet feeding part 300, via the separation and conveying part 301, the conveying roller 101, and the conveying path 112, through the sub-scanning roller 141 and the conveying roller 143 at the recording sheet carrying-in side to a printing area where printing is performed with the ink jet printing heads mounted to the carriage 121 moving in the main scanning direction as described above. The conveying roller 143 and the sub-scanning roller 141 at the recording sheet carrying-out side end of the sheet conveying path 111 may be omitted by extending the length of the stretched portion of the conveying belt 144 toward a downstream side of the recording sheet carrying-out side end of the conveying path 111 in the direction in which the recording sheet is conveyed.

The printing unit 110 includes a housing 119 having a substantially rectangular parallelepiped outer shape. The pair of guide members of the carriage 121 and the belt drive axis 146 are arranged between the front side plate 113 and a rear side plate 114, and the blank printing mechanism 160 and the maintenance mechanism part 150 are arranged inside of the front side plate 113 and the rear side plate 114, respectively. The conveying rollers 143 are supported with bearings to idle by roller axes provided between the front side plate 113 and the rear side plate 114. A pair of rails 115 extending along a direction perpendicular to the recording sheet conveying direction and protruding along the recording sheet conveying direction toward the outside, respectively, are provided to the upper edge parts of the housing 119. Handholds 116 and 117 are provided to the upper parts of the housing 119 at the side of the frond side plate 113 and the rear side plate 114, respectively.

Figure 4:
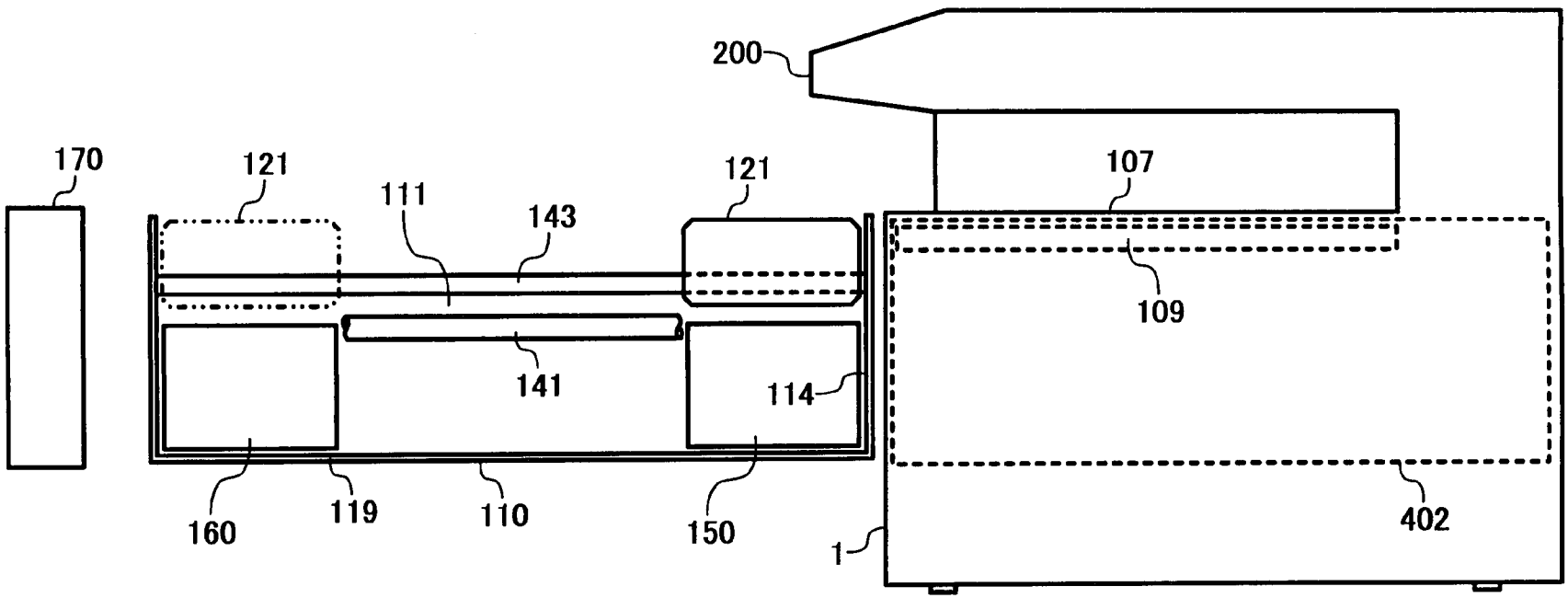
FIG. 4 is a side view when the printing unit has been drawn out.

The printing unit 110, configured as described above, is drawn out from the front of the image forming part 100 as illustrated in FIG. 4, and is detached from the image forming part 100. An opening part is provided in the front surface of the image forming part 100 so that the printing unit 110 can be drawn out. Rail guides 109 (FIG. 1) are provided to the image forming part 100 in the direction perpendicular to the recording sheet conveying direction to receive the pair of rails 115 of the printing unit 110. Further, a positioning mechanism (not shown) for the printing unit 110 is provided to the housing 402 of the image forming part 100 at the position opposing the rear side plate 114 of the printing unit 110. When the printing unit 110 is inserted into the image forming part 100 toward the rear side of the image forming part 100 along the rail guides 109, the printing unit 110 is positioned by the positioning mechanism in a final process of inserting the printing unit 110 into the image forming part 100 and is locked there. When drawing out the printing unit 110 from the image forming unit 100, by grabbing the handhold 116 at the side of the front side plate 113 by one hand and pulling the printing unit 110 in the direction in which the printing unit 110 is drawn out, the printing unit 110 is released from being locked, so that the printing unit 110 can be drawn. After the printing unit 110 has been drawn a predetermined (or maximum) distance to a position where the handhold 117 at the side of the rear side plate 114 can be grabbed, by grabbing the handhold 117 with the other hand, the printing unit 110 can be detached from the image forming unit 100. To prevent the printing unit 110 from being disengaged from the rail guides 109 before the handhold 117 at the side of the rear side plate 114 is grabbed, a stopper is provided. The stopper may be appropriately configured with the rail guides 109 and end parts of the pair of rails 115 at the side of the handhold 117 to temporarily regulate movement of the printing unit 110.

By configuring the printing unit 110 to be drawn out of the image forming part 100 as described above, maintenance work of the printing unit 110 can be performed in a state that the printing unit 110 has been drawn out from the image forming part 100. Therefore, it is not necessary to detach the image reading part 200 and the discharging tray 107 above the image forming part 100 to perform the maintenance work of the printing unit 110, so that efficiency of the maintenance work can be improved. Further, in the printing unit 110 drawn out from the image forming part 100, the printing mechanism part 120, the sub-scanning conveying mechanism part 140, the maintenance mechanism part 150, and the blank printing mechanism part 160 are sufficiently exposed, respectively, so that workability is superior.

The handhold 116 at the side of the front side plate 113 is configured by a synthetic resin belt attached to a part of the front side plate 113 with bolts, and the handhold 117 at the side of the rear side plate 114 is configured by a part of the housing 119.

Figure 5:
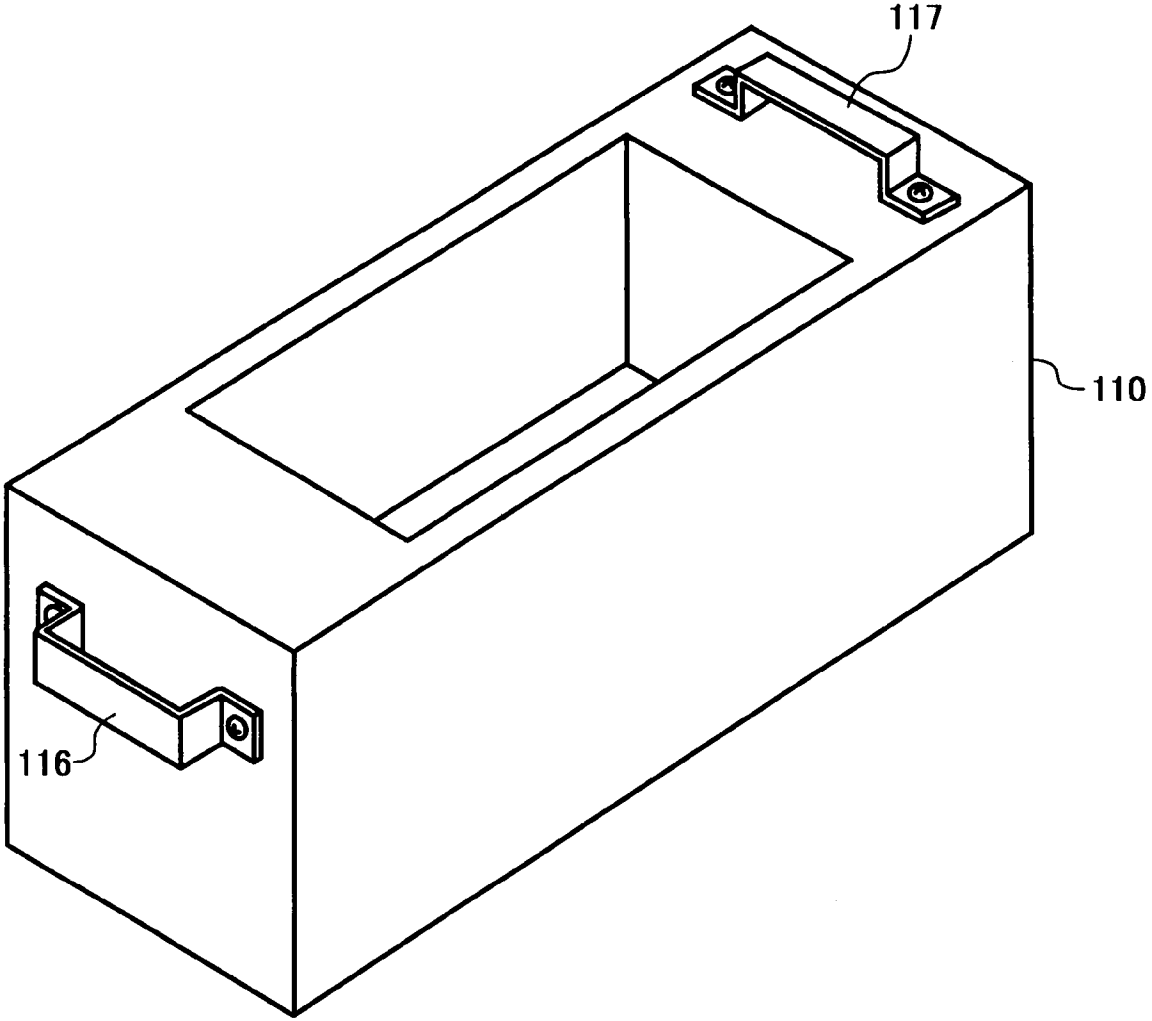
FIG. 5 is a diagram of another example of a handhold provided to the printing unit.
Figure 6B:
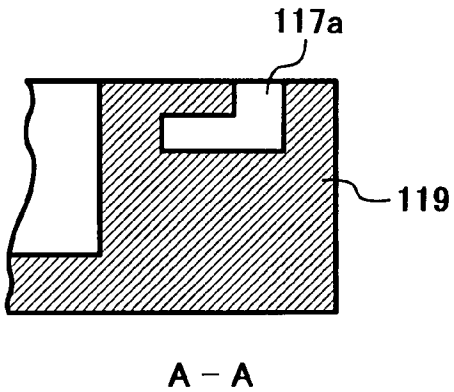
FIG. 6B is a cross section at an A-A line of FIG. 6A.
Figure 6A:
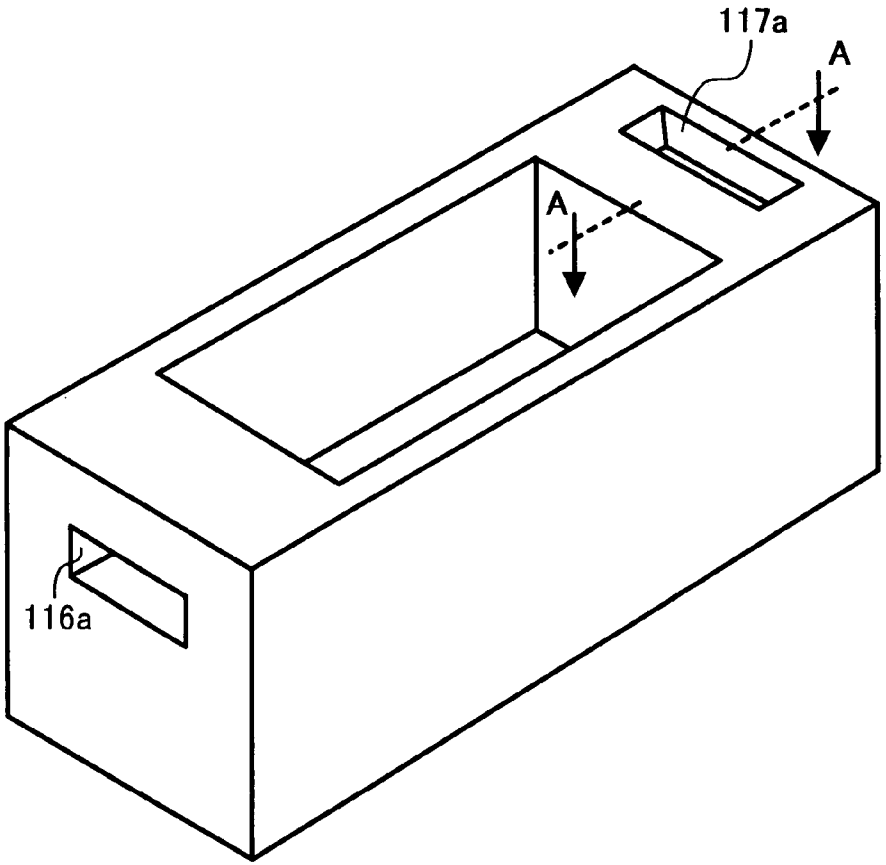
FIG. 6A is a perspective view of the printing unit in which grooves serving as handholds are provided.

However, as illustrated in FIG. 5, each of the handhold 116 and the handhold 117 may be configured by a rigid member such as metal formed in a shape that the member can be grabbed with fingers, or as illustrated in FIG. 6A, the housing 119 may be formed with a synthetic resin while integrally providing grooves 116*a* and 117*a* as handholds. In this case, as illustrated in FIG. 6B which is a cross section of the housing 119 at a A-A line of FIG. 6A, each of the grooves 116*a* and 117*a* is preferably formed in a hook-like shape so that the weight of the printing unit 110 can be born by fingers inserted into the grooves 116*a* and 117*b*.

Further, the handhold 116 illustrated in FIG. 3 may be configured such that parts of the belt, that are pressed by the bolts, are formed in grooves, respectively, and when the belt is grabbed by fingers and is pulled to be moved, end parts of the grooves of the belt are hooked by head parts of the bolts and thereby the load of the printing unit 110 is born.

In the above-described embodiment, the printing unit 110 is drawn out using a sliding mechanism configured by the pair of rails 115 and the rail guides 109. However, the printing unit 110 may be drawn out using a guide rod and a sliding or rolling mechanism arranged along the guide rod. Further, the floor surface of the image forming part 100 may be configured such that the printing unit 110 can slide and move over the floor surface. Any other configuration may be appropriately used for drawing out the printing unit 110 from the image forming part 100 and pushing the printing unit 110 into the image forming part 100 to be set there.

A cover 170 is provided to the opening part of the front surface of the image forming part 100, through which the printing unit 110 is drawn out. In the embodiment, the cover 170 is configured to cover the opening part, however, may be configured to cover the entire part of the front surface of the image forming part 100.

By configuring the copying apparatus 1 as described above, when repair or replacement is necessary relative to any element of the printing unit 110, instead of detaching the element from the printing unit 110 for repairing at a repair shop, the printing unit 100 itself can be easily replaced at the customer's premises, so that the copying apparatus 1 can be immediately put into a usable condition. Thereby, downtime can be kept at a minimum, so that user satisfaction can be increased.

Further, when detaching the printing unit 110, by first closing an ink supplying path for supplying ink from the ink tank 106 to the carriage 121, ink leakage can be avoided.

In the embodiment, the printing unit 110 as an integrated unit that can be drawn out is configured by the printing mechanism part 120, the sub-scanning conveying mechanism part 140, the maintenance mechanism part 150, and the blank printing mechanism part 160. However, the printing unit 110 may be configured, as an integrated unit that can be drawn out, by including at least the printing mechanism part 120. In this case, a control circuit to perform control of moving the carriage 121 in the main scanning direction may be also included in the printing unit 110. Furthermore, the printing unit 110 may be configured as an integrated unit that can be drawn out by including at least the printing mechanism part 120 and the sub-scanning conveying mechanism part 140. In this case also, the control circuit to perform control of moving the carriage 121 in the main scanning direction and a control circuit performing control of conveying a recording medium in the sub-scanning direction may be included in the printing unit 110.

Further, in an optical writing line printer and a thermal transfer printer using an LED for the printing mechanism part 120 of the printing unit 110, the maintenance mechanism part 150 and the blank printing mechanism part 160 used in an image forming apparatus using an ink jet printing head are not needed, so that only the printing mechanism part 120 may be included in the printing unit 110 configured as a unit that can be drawn out. In this case, the printing unit 110 may be configured to include a sub-scanning conveying mechanism, and further a control circuit may be included.

As described above, in an image forming apparatus using an ink jet printing method, when detaching a printing unit from the main body of the apparatus, besides mechanical detachment of the printing unit from the main body of the apparatus, detachment of electrical systems connecting the printing unit and the main body of the apparatus must be also considered. Herein below, another feature of an embodiment of the present invention concerning detachment of electrical systems connecting a printing unit and the main body in an image forming apparatus using an ink jet printing system is described. In the following description, parts identical or corresponding to those in the previous embodiment are designated with like reference numerals, and overlapping descriptions are omitted.

Figure 7B:
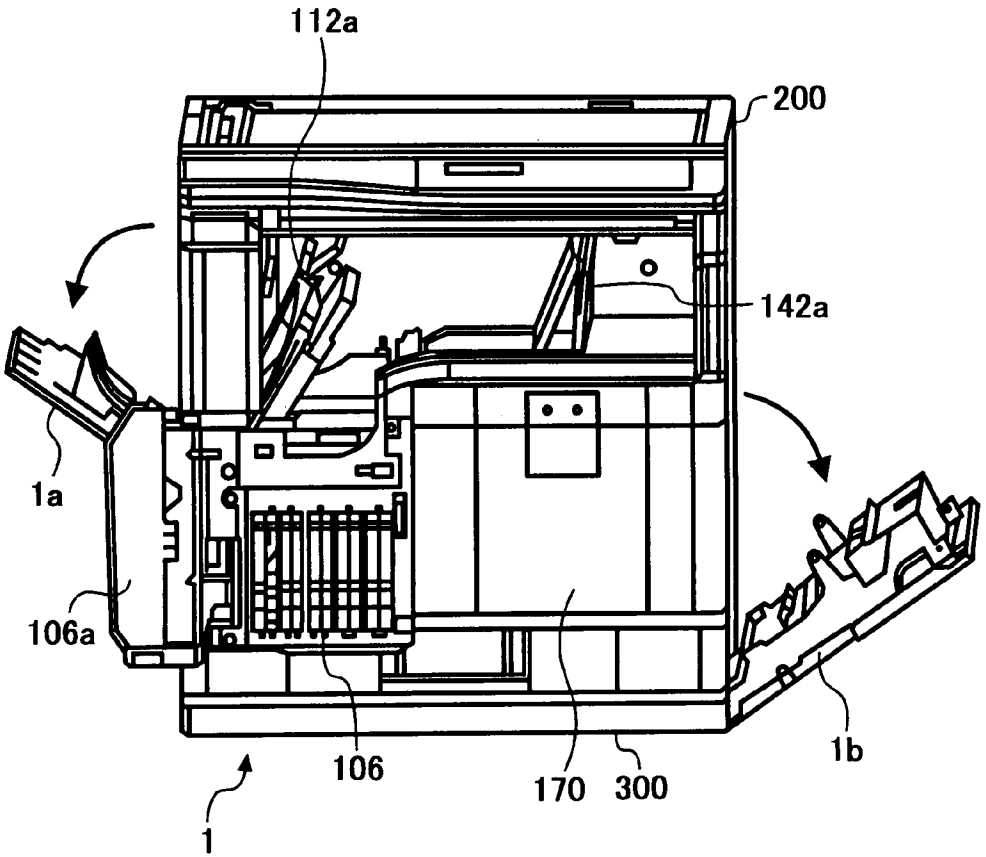
FIG. 7B is a diagram illustrating a state of the copying apparatus of FIG. 7B when every cover that can be opened for clearing a jammed sheet has been opened.
Figure 7A:
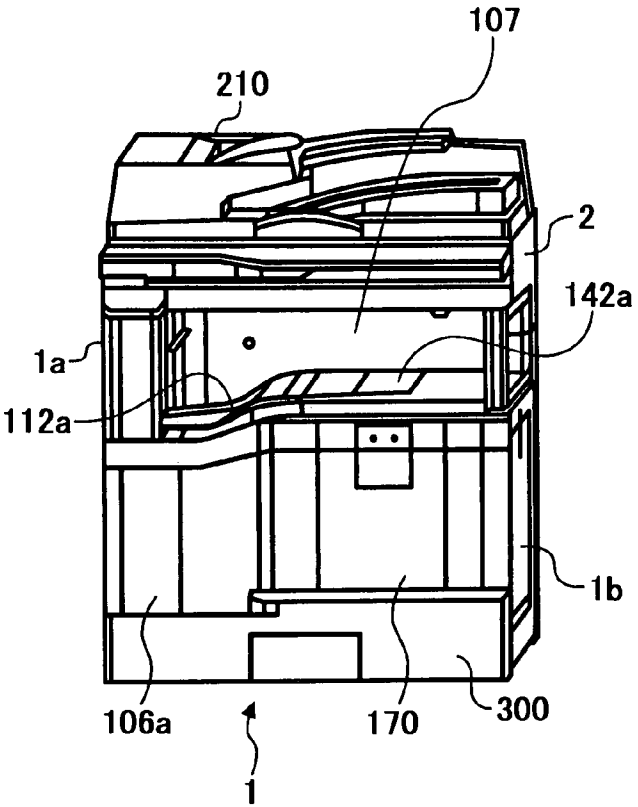
FIG. 7A is a diagram illustrating an outer appearance of the copying apparatus according to another preferred embodiment of the present invention, viewed almost from the front side.

FIG. 7A and FIG. 7B illustrate the copying apparatus 1 according to another preferred embodiment of the present invention, in which detachment of electrical systems connecting the printing unit 110 and the main body and clearance of jammed sheets have been considered. FIG. 7A illustrate an outer appearance of the copying apparatus 1 viewed almost from the front side, and FIG. 7B illustrates a state of the copying apparatus 1 when every cover that can be opened for clearing a jammed sheet has been opened.

In the copying apparatus 1, the cover 170 covering the front part of the printing unit 110 accommodated in the copying apparatus 1 by covering the opening part of the front surface of the image forming part 100 as described above is configured to open. Further, as illustrated in FIG. 7B, first and second conveying path covers 1*a* and 1*b* as side covers of the copying apparatus 1 are configured to open to expose portions of the conveying path 112, an ink tank cover 106*a* covering the front side of the ink tank 106 is configured to open, a third conveying path cover 112*a* covering a portion of the conveying path 112 above the ink tank 106 is configured to open, and a fourth conveying path 142*a* covering the platen 142 is configured to open. Upper surfaces of the third conveying path cover 112*a* and the fourth conveying path cover 142*a* function as the discharging tray 107, and therefore a sheet surface detect sensor 107*a* (FIG. 11) is provided above the third conveying path cover 112*a*. In FIG. 7A, an ADF 210 mounted above the contact glass 201 is illustrated.

Figure 8:
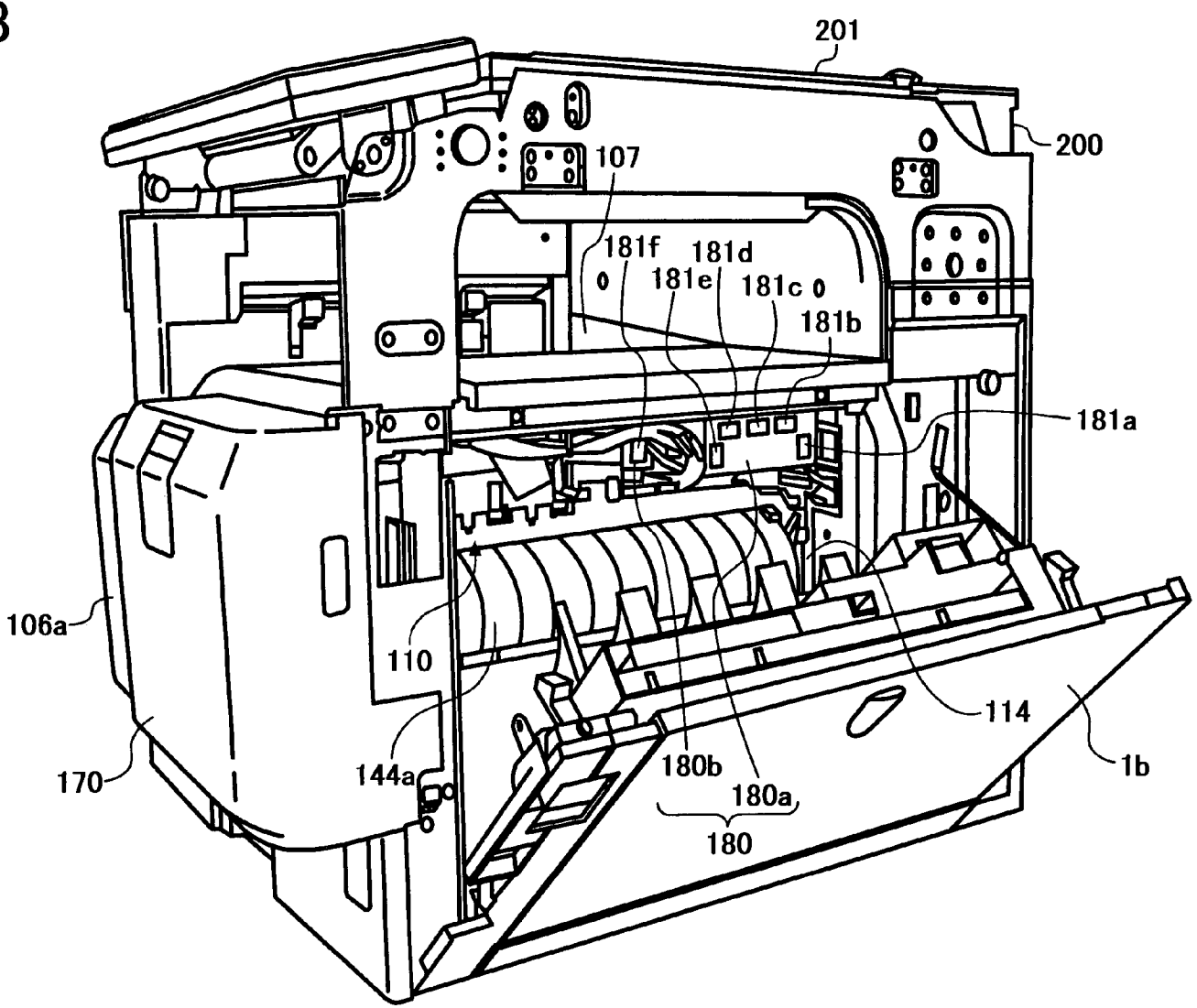
FIG. 8 is a perspective view illustrating a state of the copying apparatus when a conveying path cover at the right side in the front view of the copying apparatus is opened.
Figure 9:
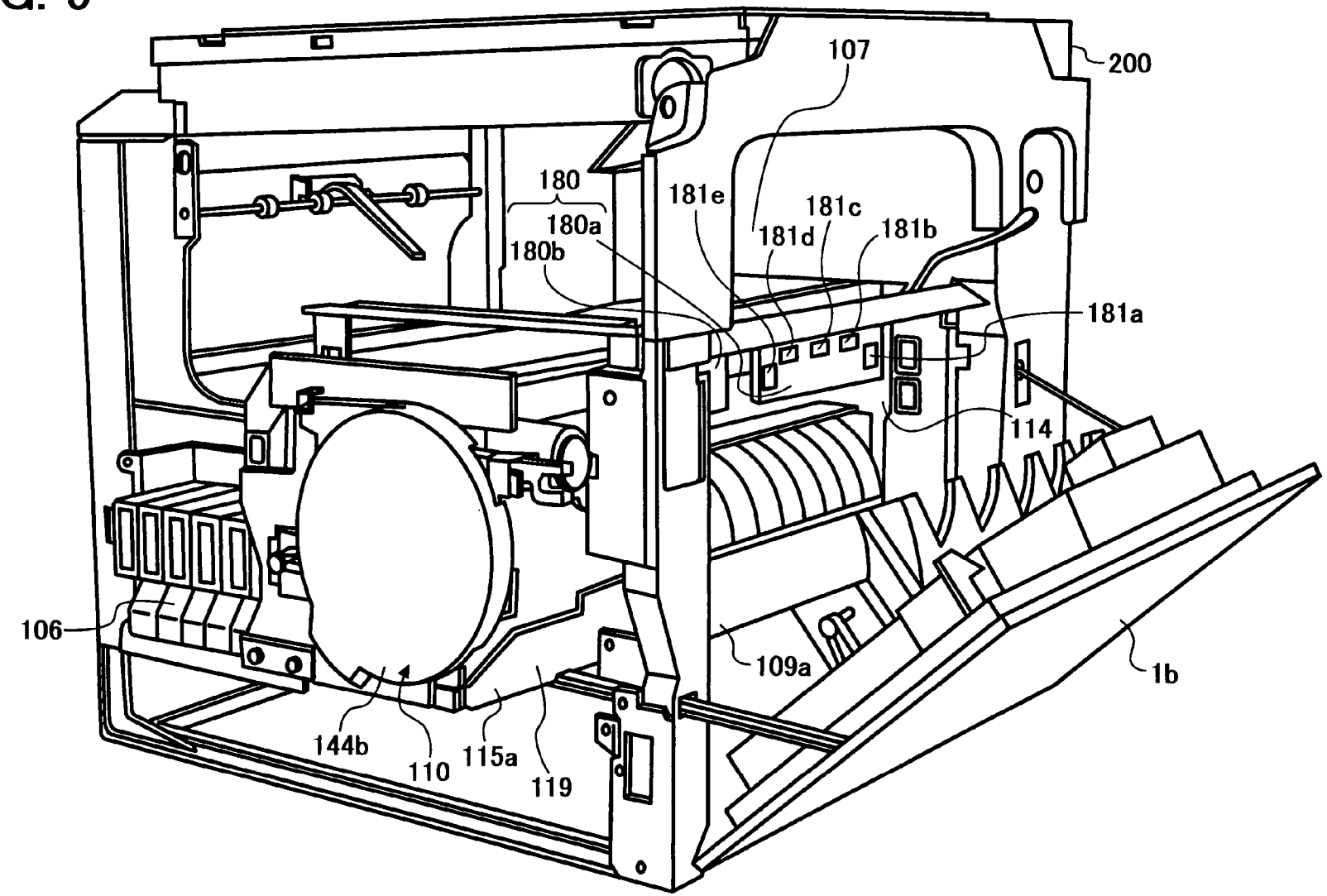
FIG. 9 is a perspective view of the copying apparatus in which a cover covering the front side of the printing unit and an ink tank cover are omitted.
Figure 10:
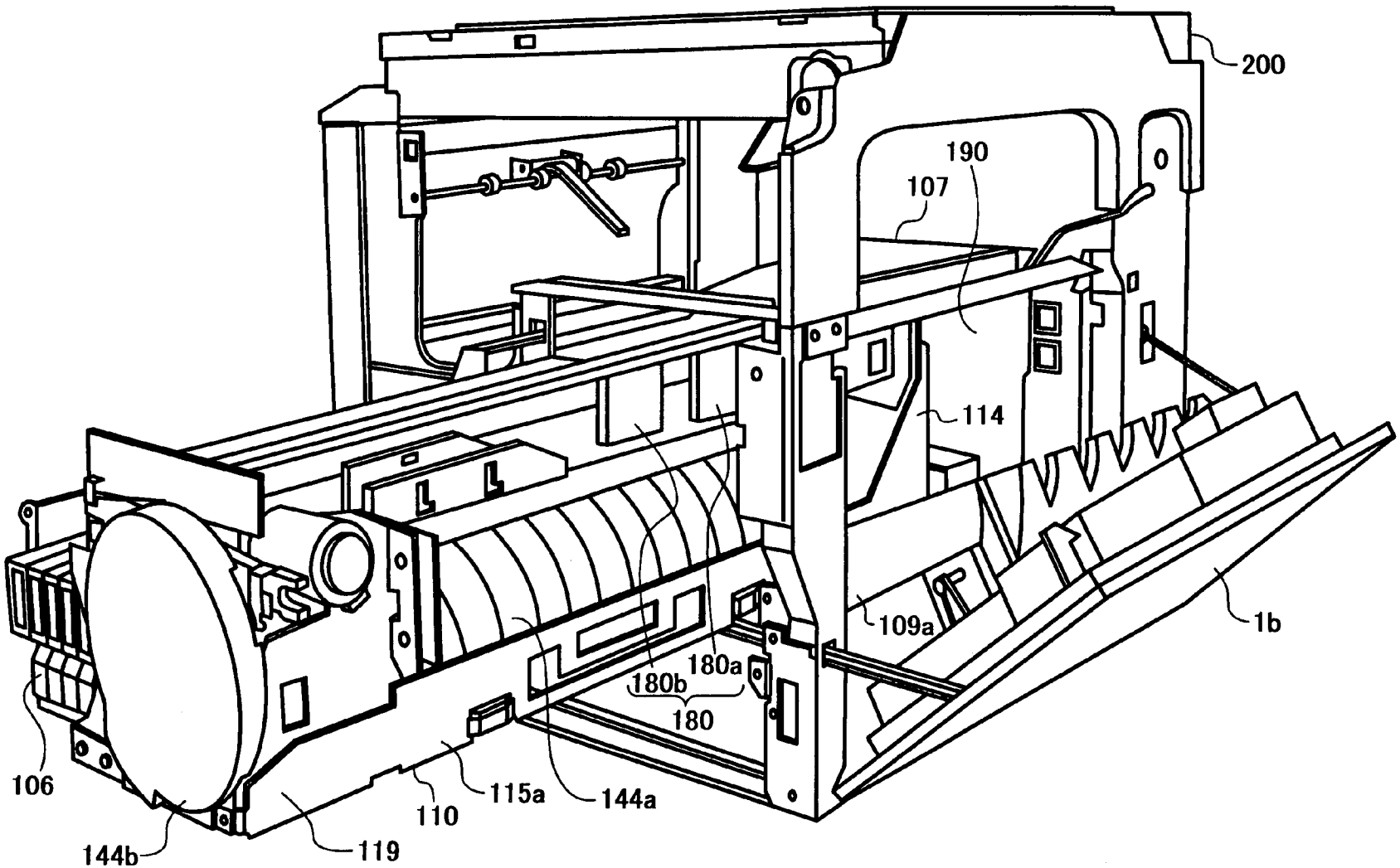
FIG. 10 is a perspective view illustrating a state of the copying apparatus in which the printing unit has been drawn out.
Figure 11:
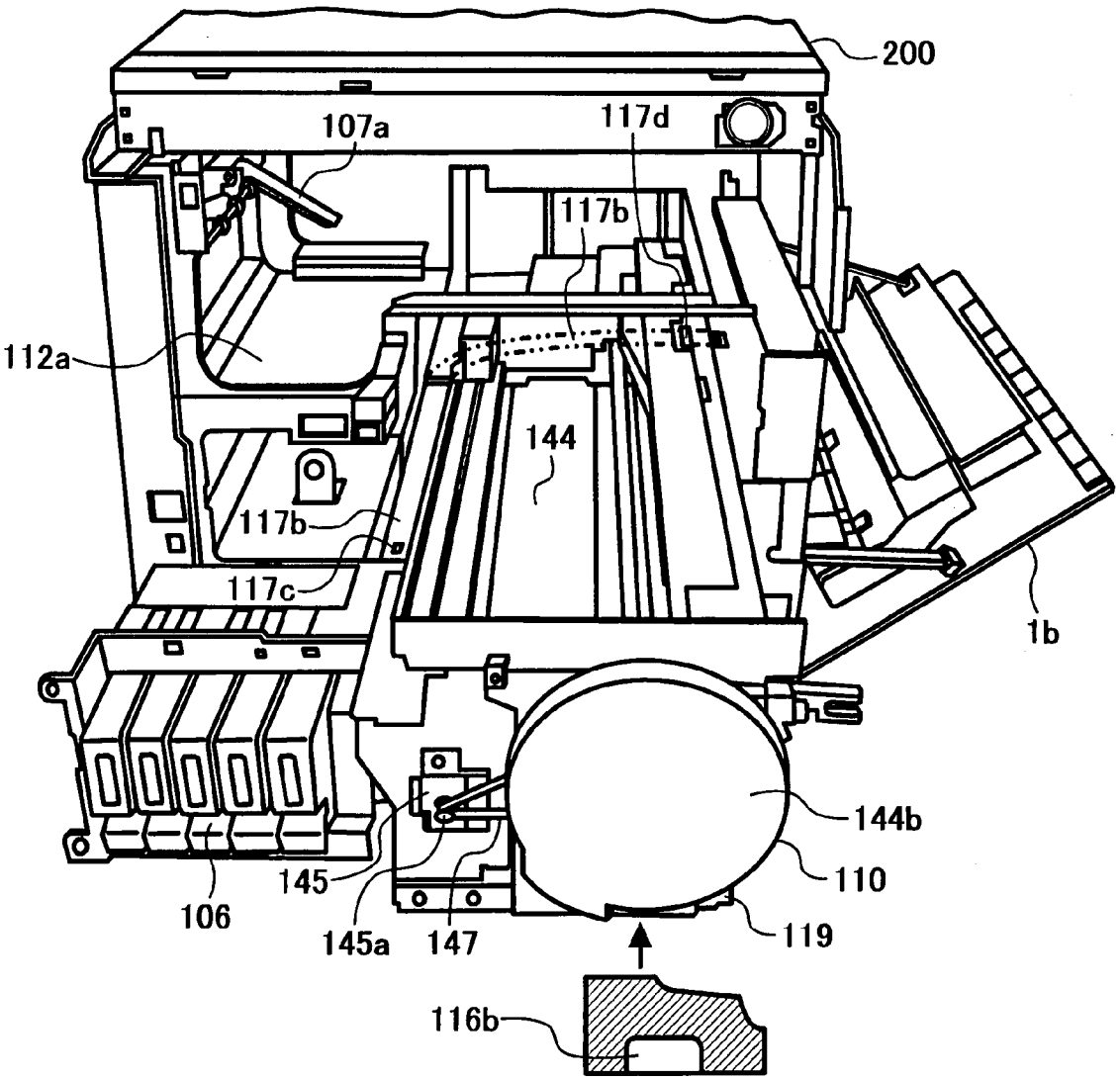
FIG. 11 is a perspective view illustrating the state of the copying apparatus of FIG. 10, viewed from the front side of the copying apparatus.
Figure 12:
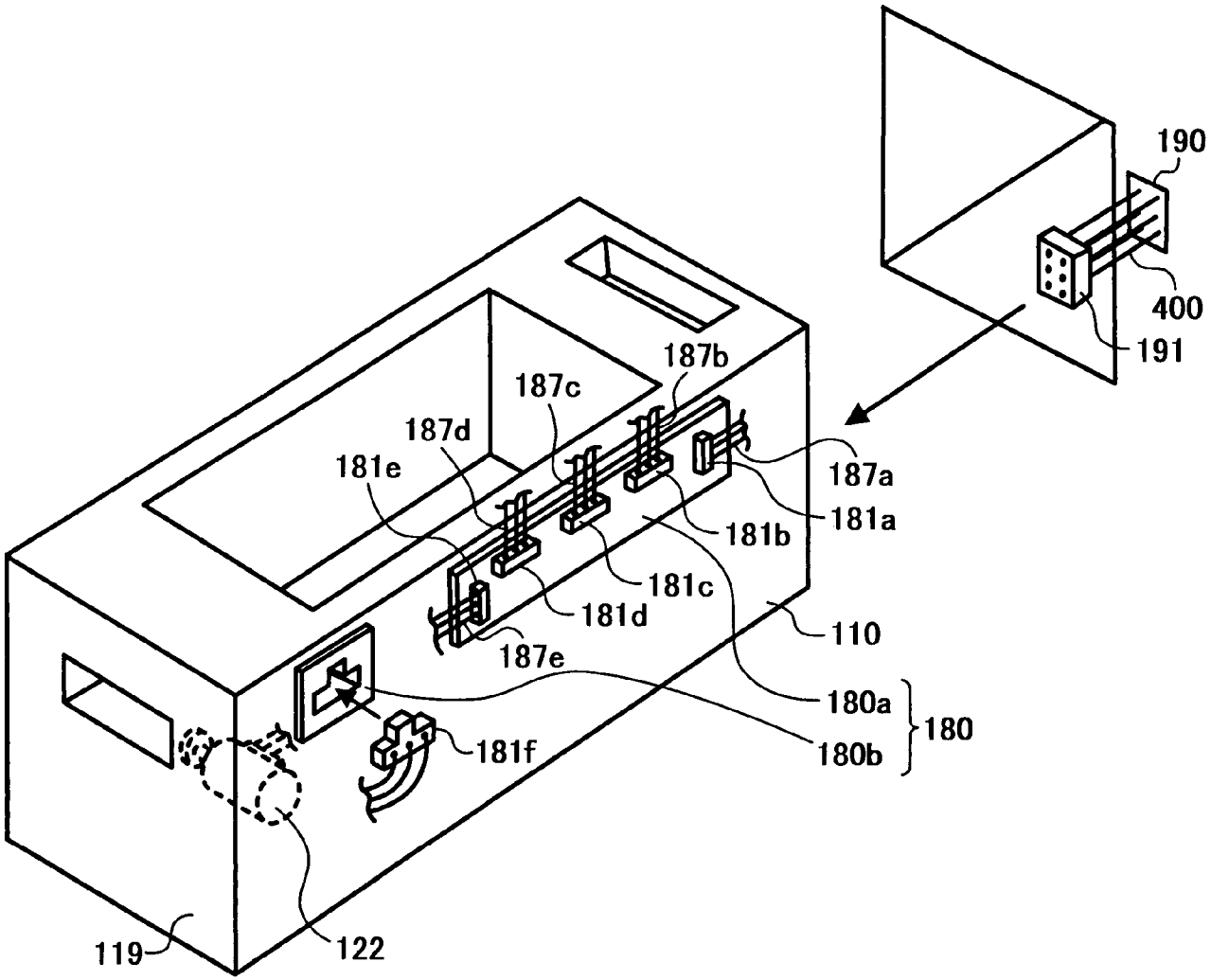
FIG. 12 is a schematic perspective view of the printing unit illustrating a state of a connector part thereof.

FIG. 8 illustrates a state of the copying apparatus 1 when the second conveying path cover 1*b* (at the right side in the front view of the copying apparatus 1) is opened, FIG. 9 is a perspective view of the copying apparatus 1 in which the cover 170 and the ink tank cover 106*a* are omitted, FIG. 10 is a perspective view illustrating a state of the copying apparatus 1 in which the printing unit 110 has been drawn out, and FIG. 11 is a perspective view illustrating the state of the copying apparatus 1 of FIG. 10, viewed from the front side of the copying apparatus 1. As illustrated in FIGS. 8, 9 and 10, a connector part 180 configured by a first connector board 180*a* and a second connector board 180*b* is arranged at an upper part of a side surface of the housing 119 of the printing unit 110, that opposes the first conveying path cover 1*b* when the printing unit 110 is accommodated in the main body of the copying apparatus 1. Thereby, when the first conveying path cover 1 is opened, the connector part 180 is exposed. Respective parts of the printing unit 110 and a main body control board 190 (FIG. 10) at the side of the main body of the copying apparatus 1 are connected with each other through the intermediary of the connector part 180. In this embodiment, the connection function of the connector part 180 is divided between the first connector board 180*a* and the second connector board 180*b*. The first connector board 180*a* and the second connector board 180*b* are provided to the side surface of the housing 119 of the printer unit 110 as illustrated in FIG. 12, so as to be parallel to a side surface of the copying apparatus 1. Symbol 144*a* denotes a conveying guide plate arranged around a periphery of the conveying belt 144 (see FIG. 3) so that the conveying belt 144 will not be exposed when the first conveying path cover 1*b* has been opened. Further, as illustrated in FIG. 11, an encoder system 144*b* is provided to the front surface of the printing unit 110 to detect a rotation amount of the sub-scanning motor 145 (see also FIG. 3) driving the conveying belt 144. The encoder system 144*b* is configured to detect a conveying distance of a recording sheet in the sub-scanning direction by counting the number of pulses of an encoder, which is rotated by a driving force of a rotation axis 145*a* of the sub-scanning motor 145, with an encoder sensor (not shown), and converting the number of pulses into a rotation amount.

As illustrated in FIG. 12 illustrating a state of the connector part 180, at the side of the first connector board 180*a* arranged are a connector 181*a* for connection with the main body control board 190, connectors 181*b*, 181*c* and 181*d* connecting with respective parts of the printing unit 110, such as the printing heads mounted to the carriage 121 of the printing mechanism part 120, the maintenance mechanism part 150, and the blank printing mechanism part 160, and a connector 181*e* for connection with the second connector board 180*b*. Wiring patterns are formed at the back surface of the first connector board 180*a* to connect the connector 181*a* with the connector 181*b*, the connector 181*c*, the connector 181*d* and the connector 181*e*. By connecting a connector 191 at a tip end of signal lines 400 from the main body control board 190 with the connector 181*a*, connection of the main body control board 190 and respective parts of the printing unit 110 is realized through the intermediary of the wiring patterns and the connectors 181*b*, 181*c* and 181*d* and connecting cables 187*b*, 187*c* and 187*d* connecting to the respective parts of the printing unit 110. The connector 181*a*, the connector 181*b*, the connector 181*c*, the connector 181*d* and the connector 181*e* are arranged such that respective connecting cables do not cross each other and thereby noise will not be picked up. The second connector board 180*b* is connected with the first connector board 1980*a* via the connector 181*e* and is configured such that signals for controlling the sub-scanning conveying mechanism part 140 and the printing mechanism part 120 are inputted and outputted via a connector 181*f*.

In FIG. 12, the connector part 180, i.e., the first connector board 180*a* and the second connector board 180*b*, are arranged substantially along the entire portion of the side surface of the printing unit 110 in the longitudinal direction, however, the first connector board 180*a* and the second connector board 180*b* are actually arranged at positions closer to the rear side plate 114 of the printing unit 110 as illustrated in FIG. 8 such that lengths of the connecting cables 187*b*, 187*c*, 187*d* and 187*e* are minimal and thereby pick-up noise is minimized. Further, the connector 181*a* is arranged in the first connector board 180*a* at a position closest to the rear side plate 114. Here, the main body control board 190 is arranged at a rear part in the main body of the copying apparatus 1 and at the side of the first conveying path cover 1*b*, so that lengths of the connecting cables 400 of the connector 191 of the main body control board 190 are made relatively short. Further, as described above, the connector part 180 configured by the first connector board 180*a* and the second connector board 180*b* is provided to the side surface of the printing unit 110 opposing the second conveying path cover 1*b* when the printing unit 110 is accommodated in the main body of the copying apparatus 1, so that the connector part 180 is exposed by opening the second conveying path cover 1*b*. Thus, by opening the second conveying path cover 1*b* and by detaching the connector 191 of the main body control board 190 from the connector 181*a* of the first connector board 180*a*, electrical connection between the printing unit 110 and the main body control board 190 is disconnected, and thereby the printing unit 110 can be detached from the main body of the copying apparatus 1. Further, because the lengths of the connecting cables 400 extending from the main control board 190 of the main body are made relatively short as described above, when detaching the printing unit 110 from the main body of the copying apparatus 1, the connecting cables 400 will not be obstructive.

Figure 13:
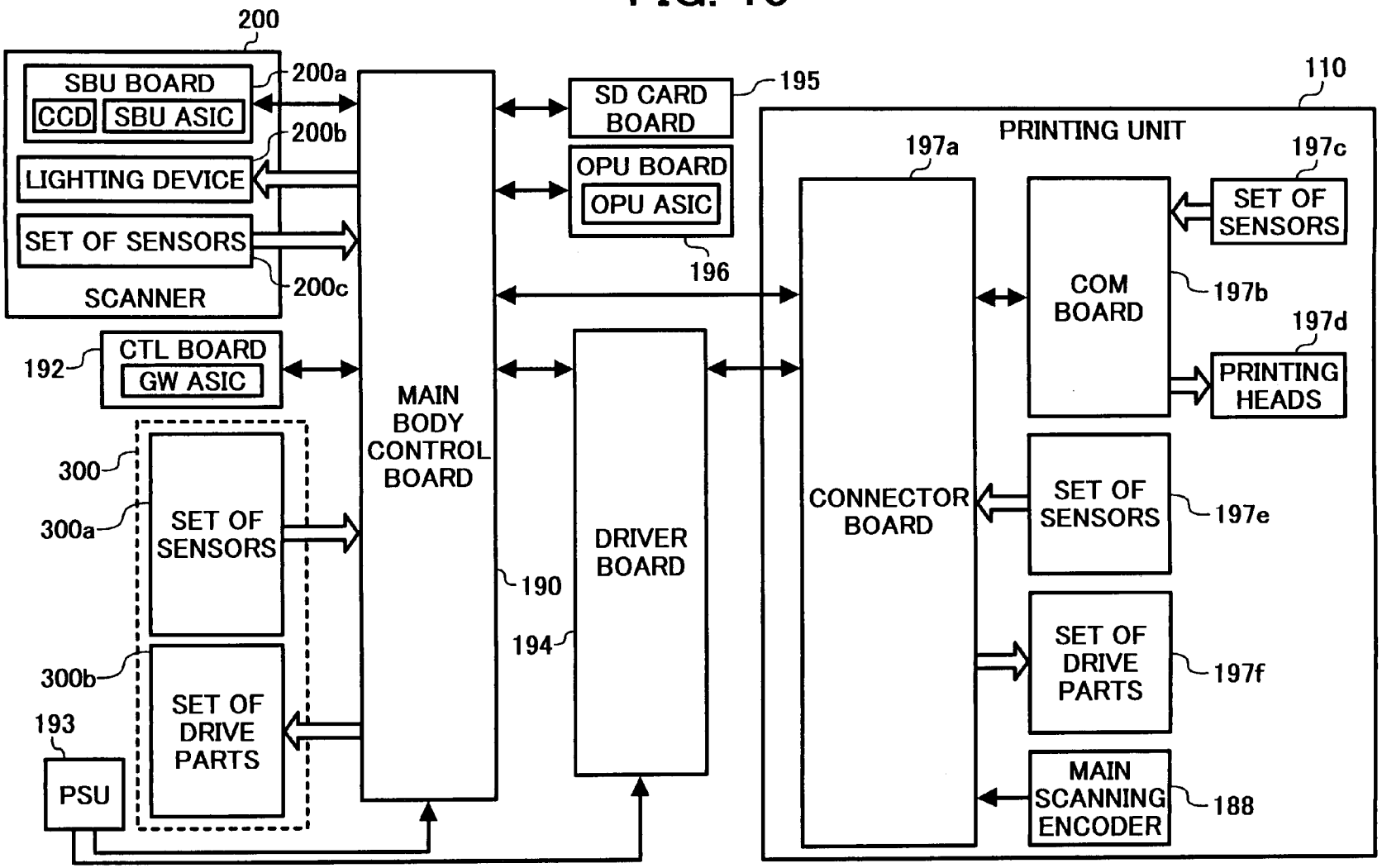
FIG. 13 is a block diagram for explaining control of the copying apparatus.

FIG. 13 is a block diagram for explaining control of the copying apparatus 1. In the copying apparatus 1 illustrated in FIG. 8 through FIG. 12, the connector part 180 configured by two boards, i.e., the first connector board 180*a* and the second connector board 180*b*, is used. However, the connector part 180 may be configured by a single board, and in FIG. 13, a connector board 197*a* as an example of the connector part 180 configured by a single board is used for the connector part 180.

The main body control board 190 includes a control part including a CPU, a ROM and a RAM, a driver for driving drive parts such as a pump, a motor, etc., and other control elements used for the control. The image reading part 200 includes an SBU (scanner board unit) 200*a* including a CCD and an SBU ASIC, a lighting device 200*b*, and a set of sensors 200*c* including a HP (home position) sensor, an APS sensor, and an original platen open/close sensor. Inputting and outputting of detect signals and control signals are performed between the image reading part 200 and the main body control board 190. A CTL (controller) board 192 is provided with a GWS ASIC and is configured to perform control of displaying and control of inputting and outputting at an operation and display part of the copying apparatus 1. The CTL board 192 outputs and inputs signals to and from the main body control board 190.

The sheet feed part 300 includes a set of sensors 300*a* and a set of drive parts 300*b* for sheet feeding. The main body control board 190 receives detect signals from the set of sensors 300*a* and sends drive signals to the set of drive parts 300*b*. The set of sensors 300*a* includes, for example, a registration sensor, a relaying sensor, a size detect sensor, a sheet existence detect sensor, a cover open/close sensor, etc. The set of drive parts 300*b* includes motors, solenoids and clutches for driving the conveying rollers 101, 102, 103 and 143, the discharging roller 105, the sub-scanning rollers 141, and the feeding roller of the separation and conveying part 301.

A PSU (power source unit) 193 supplies power to respective parts of the copying apparatus 1. A driver board 194 includes piezoelectric thermistors, and is configured to control discharging of ink at the ink jet printing heads for respective colors mounted to the carriage 121 of the printing unit 110. The driver board 194 is connected with the main body control board 190 and the printing unit 110. The main body control board 190 is also connected with an SD card board 195 and an OPU (optional unit) board 196. The SD card board 195 enables updating of a program and installing of a new program using an SD card, and the OPU board 196 enables connection of an optional unit.

The printing unit 110 includes the connector board 197*a* as an example of the connector part 180 configured by a single board, and a COM (common) board 197*b* connected with printing heads 197*d* for respective colors (i.e., the ink jet printing heads mounted to the carriage 121) and a set of sensors 197*c* concerning the printing heads 197*d*. The printing unit 110 further includes a set of sensors 197*e* concerning other parts than the printing heads 197*d*, a set of drive parts 197*f* including clutches, solenoids, etc., and a main scanning encoder 188. In this embodiment, printing heads for 5 colors are provided, so that five units of the set of the sensors 197*e* and the set of drive parts 197*f* are provided, respectively. The set of sensors 197*c* concerning the printing heads 197*d* includes, for example, a head environmental temperature sensor, an image registration sensor, and an air detect sensor. The set of sensors 197*e* concerning parts other than the printing heads 197*d* includes a rotary encoder sensor for the sub-scanning direction, a carriage rising sensor, and an ink cartridge existence detect sensor. The set of drive parts 197*f* includes a sheet counter, various types of clutches, and a motor.

As described above, the connector board 197*a* corresponds to the connector part 180 in this embodiment, and through the intermediary of the connector board 197*a*, the main body control board 190 and the driver board 194 at the side of the main body of the copying apparatus 1 are connected with the COM board 197*b*, the sets of sensors 197*e*, the sets of drive parts 197*e*, etc. of the printing unit 110. The COM board 197*b* and the connector board 197*a* are connected with 75 signal lines, the sets of sensors 197*e* and the connector board 197*a* are connected with 55 signal lines, the sets of drive parts 197*f* and the connector board 197*a* are connected with 32 signal lines, and the main scanning encoder 188 and the connector board 197*a* are connected with 6 signal lines, although a heavy or outline arrow line is used in illustrating each connection in FIG. 13. Thus, the signal lines of the connector board 197*a* almost amount to 170, and if signal lines for communicating with the maintenance mechanism part 150 and the blank printing mechanism part 160 are added, the signal lines of the connector board 197*a* amount to about 200. Therefore, a plurality of connectors are provided on the connector board 197*a*, i.e., the connector 181*a* for connection with the main body control board 190, and the connectors 181*b*, 181*c* and 181*d* connecting with respective parts of the printing unit 110, that are provided, in FIG. 12, to the first connector boat 180*a*, and the connector 181*f* connecting with the sub-scanning conveying mechanism part 140 and the printing mechanism part 120, that is arranged, in FIG. 12, for connection with the second connector board 180*b*, and wiring patterns are formed at the back surface of the connector board 197*a* to connect the connector 181*a* with the connectors 18l*b*, 181*c*, 181*d* and 181*f*. By connecting the connector 191 at the tip ends of the signal lines 400 from the main body control board 190 with the connector 181*a* as in FIG. 12, connection of the main body control board 190 with the COM board 197*b*, the sets of sensors 197*e*, the sets of drive parts 197*f*, and the main scanning encoder 188, etc., is realized, so that connection of the main body control board 190 with respective parts of the printing unit 110 is realized. Thus, when drawing out the printing unit 110 from the main body of the copying apparatus 1, by detaching the connector 191 from the connector 181*a*, connection between the main body control board 190 and the printing unit 110 is broken electrically and physically, so that the printing unit 110 can be drawn out of the main body of the copying apparatus 1.

When the connector part 180 is configured by the first connector board 180*a* and the second connector board 180*b* and the connector 181*f* is provided for connection with the second connector board 180*b*, the signals for controlling the sub-scanning conveying mechanism 140 and the printing mechanism part 120 are inputted to and outputted from the second connector board 180*b* via the connector 181*f* as described above. Therefore, the sub-scanning conveying mechanism part 140 and the printing mechanism part 120 can be replaced independently from other parts by detaching the connector 181*f*, respectively.

Further, it is needless to say that the connector part 180 can be configured with three or more boards.

In this embodiment, the handhold 117*b* at the rear side of the printing unit 110 is configured with a belt and the handhold 116*b* at this side (the front side) is configured by a concave part provided at the bottom part of the front side of the printing unit 110 as illustrated in FIG. 11. When the printing unit 110 is set in the main body of the copying apparatus 1, the handhold 117*b* at the rear side retreats along the upper surface of a frame extending in a direction perpendicular to the sheet conveying direction with a tip end thereof fastened with a pin 117*c*. When drawing out the printing unit 110, the tip end of the handhold 117*b* is disengaged from the pin 117*c* and the handhold 117*b* is bent in the direction perpendicular to the frame as indicated by a dashed line in FIG. 11 and the tip end thereof is fixed to a fixing clasp 117*d* so that the handhold 117*b* can be grasped by fingers. By grasping the handhold 117*b* at the rear side, which is configured with the belt, and the handhold 116*b* at the front side, which is configured by the concave part, as described above, the printing unit 110 can be easily lifted. Accordingly, after drawing out the printing unit 110 to a predetermined position, the printing unit 110 can be easily detached from the main body of the copying apparatus 1.

In this embodiment, the ink tank 106 is integrated with the printing unit 110, as illustrated in FIG. 11, at a left side front part (when the copying apparatus 1 is viewed from the front side) of the printing unit 110. For example, the ink tank 106 may be integrated with the printing unit 110 by screwing a member (not shown) extending from the ink tank 106 toward the printing unit 110 on the printing unit 110. Accordingly, when the printing unit 110 is drawn and is detached from the main body of the copying apparatus 1, the ink tank 106 is drawn integrally with the printing unit 110 to be detached from the main body of the copying apparatus 1, so that it is not necessary to detach an ink supply path (not shown), which supplies ink from the ink tank 106 to the printing heads of the printing unit 110, from the printing unit 110. Thereby, there is no possibility that ink leaks from the ink supply path when detaching the printing unit 110 from the main body of the copying apparatus 1, so that the printing unit 110 can be easily detached.

In this embodiment, differently from the previous embodiment, the printing unit 110 is supported at a lower rail 115*a* by a rail guide 109*a* of the main body of the copying apparatus 1 to be drawn out, as illustrated in FIG. 9 and FIG. 10. Thereby, an upper rail guide (the rail guides 109) in the previous embodiment is not necessary, so that freedom in a space above the printing unit 110 is increased and a relatively large working space can be secured. When clearing a jammed sheet, as illustrated in FIG. 7B, the cover 112*a* above the conveying path 112 and the cover 142*a* covering the platen 142 are opened. In this case, in the previous embodiment, there is a possibility that the rail guides 109 interfere with clearing of a jammed sheet. However, in this embodiment, as illustrated in FIG. 11, because no element exists in the apace above the printing unit 110, clearing of a jammed sheet is relatively easy.

Figure 14:
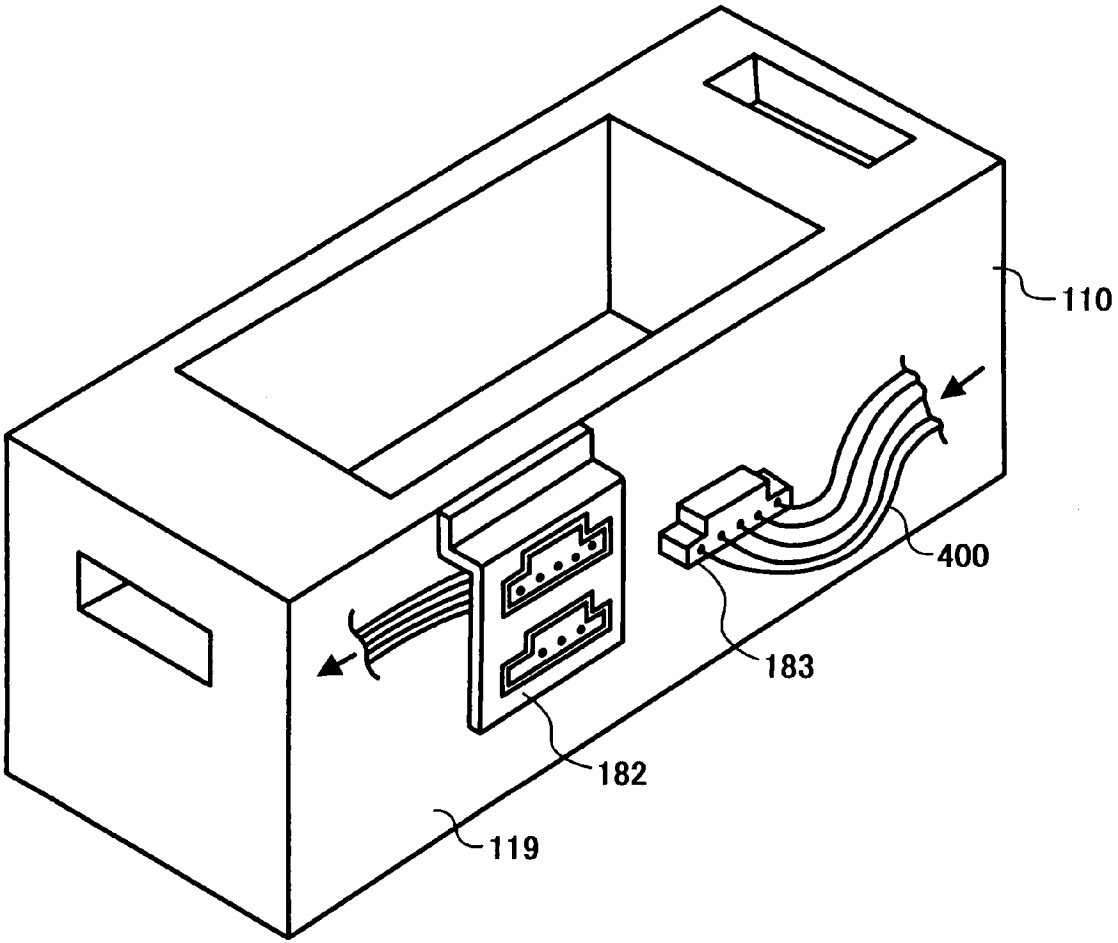
FIG. 14 is a schematic perspective view of the printing unit illustrating another example of the connector part.

In this embodiment, the connector part 180 is configured by the connector board 197*a* as in FIG. 13 or by the first and second connector boards 180*a* and 180*b* as in FIG. 12. However, the connector part 180 may be configured, as illustrated in FIG. 14, by a panel mount 182 having a plurality of connecting terminals connected with respective parts of the printing unit 110. In this case, for example, a connector 183 connected with signal lines 400 from the main board control board 190 is connected with each of the plurality of terminals of the panel mount 182. The positions and the numbers of pins of the connecting terminals of the panel mount 182 and the connectors 183 may be set to correspond to each other to avoid erroneous connection. As necessary, plural units of the panel mount 182 may be provided.

Figure 15:
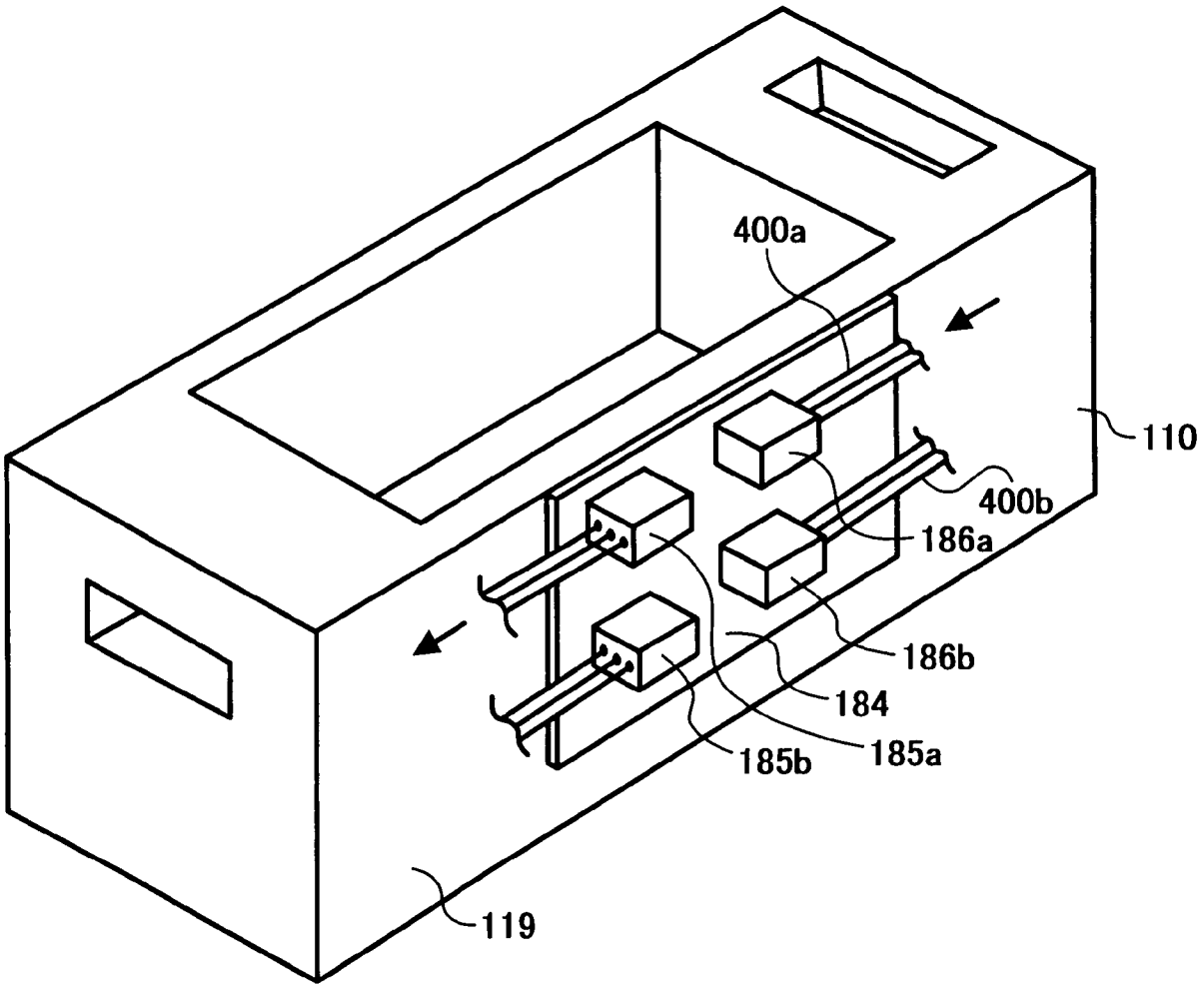
FIG. 15 is a schematic perspective view of the printing unit illustrating another example of the connector part.

Further, as illustrated in FIG. 15, the connector part 180 may be configured by a printed circuit board 184 provided to a side surface of the printing unit 110, and a plurality of connectors divided by functions, arranged on the printing circuit board 184 and connecting with respective parts of the printing unit 110. In this example, a connector 185*a* and a connector 185*b* are provided on the printed circuit board 184. A plurality of connectors, in this example, a connector 186*a* and a connector 186*b*, provided at tip ends of signal lines 400 and 400*b* from the main body control board 190, are connected to the connector 185*a* and the connector 185*b*. In this case also, the positions and the numbers of pins of the connectors on the printing circuit board 184 and the connectors at the tip ends of signal lines from the main body control board 190 may be set to correspond to each other to avoid erroneous connection.

In the above-described embodiments, the copying apparatus 1 including the image reading part 200 arranged above the image forming part 100 has been used as an example of the image forming apparatus of the present invention. However, it is needless to say that the present invention can be applied to a printer in which an image reading part is not included.

Numerous additional modifications and variations of the present invention are possible in light of the above teachings. It is therefore to be understood that within the scope of the appended claims, the present invention can be practiced otherwise that as specifically described herein.

The invention claimed is:

1. An image forming apparatus comprising:

a printing unit including an inkjet printing head configured to eject ink onto a recording medium, the printing unit including a carriage having the ink jet printing head mounted thereto, the carriage moving along a guide member in a main direction perpendicular to a recording medium conveying direction, the printing unit further including a maintenance mechanism configured to maintain a writing function of the inkjet printing head, said maintenance mechanism including a cleaner configured to clean a surface of the ink jet printing head; and a guide device configured to guide the printing unit, when the printing unit is drawn from the image forming apparatus, in a substantially horizontal direction and in a direction substantially perpendicular to a recording medium conveying direction, the guide device extending substantially perpendicular to the recording medium conveying direction and in a substantially horizontal direction, wherein the maintenance mechanism is drawn together with the inkjet printing head, and is arranged in an innermost portion with respect to a direction of removal from the image forming apparatus, and the inkjet printing head is located opposing the maintenance mechanism when the maintenance mechanism is drawn together with the inkjet printing head, wherein the maintenance mechanism is drawn in the main direction.

2. The image forming apparatus according to claim 1, wherein the guide device comprises:

a guide member connected to the apparatus and extending in the direction substantially perpendicular to the recording medium conveying direction; and a guided member connected to the printing unit and configured to be guided by the guide member.

3. The image forming apparatus according to claim 2, wherein the guided member connected to the printing unit comprises:

a protruding member, wherein the protruding member is supported by the guide member connected to the apparatus so as to be movable in the direction substantially perpendicular to the recording medium conveying direction.

4. The image forming apparatus according to claim 1, wherein the guide device comprises:

a floor surface of an accommodating part of the apparatus accommodating the printing unit.

5. The image forming apparatus according to claim 1, wherein the guide device supports the printing unit so as to be detachable from the apparatus.

6. The image forming apparatus according to claim 1, wherein the printing unit comprises:

a printing mechanism including a carriage configured to mount the ink jet printing head and configured to move the carriage in a main scanning direction.

7. The image forming apparatus according to claim 6, wherein the printing unit further comprises:

a maintenance mechanism configured to maintain a writing function of the ink jet printing head.

8. The image forming apparatus according to claim 6, wherein the printing mechanism further comprises:

a control circuit configured to control movement of the carriage in the main scanning direction.

9. The image forming apparatus according to claim 6, wherein the printing unit further comprises:

a connection device configured to connect the printing mechanism of the printing unit with a control part of the apparatus, wherein the connection device is exposed when the printing unit is accommodated in the apparatus and a side cover of the apparatus has been opened.

10. The image forming apparatus according to claim 9, wherein the connection device further comprises:

a board fixed to the printing unit; and a first connector arranged on the board and configured to connect with the control part of the apparatus.

11. The image forming apparatus according to claim 10, wherein the connection device further comprises:

a second connector arranged on the board and configured to connect with the printing mechanism of the printing unit; and a wiring pattern formed on the board and configured to connect the second connector and the first connector.

12. The image forming apparatus according to claim 9, wherein the connection device further comprises:

a board fixed to the printing unit; and a connector arranged on the board and configured to connect the printing mechanism of the printing unit and the control part of the apparatus.

13. The image forming apparatus according to claim 6, wherein the printing unit further comprises:

a sub-scanning conveying mechanism configured to convey the recording medium in a sub-scanning direction at a part of the printing unit where an image is formed on the recording medium.

14. The image forming apparatus according to claim 13, wherein the sub-scanning conveying mechanism comprises:

a conveying roller;

a platen; and a drive source configured to drive the conveying roller.

15. The image forming apparatus according to claim 13, wherein the sub-scanning conveying mechanism comprises:

a conveying roller;

a conveying belt; and a drive source configured to drive at least one of the conveying roller and the conveying belt.

16. The image forming apparatus according to claim 15, wherein the conveying belt is an electrostatic belt.

17. The image forming apparatus according to claim 13, wherein the sub-scanning conveying mechanism comprises:

a control circuit configured to control conveying the recording medium in the sub-scanning direction.

18. The image forming apparatus according to claim 13, wherein the printing unit further comprises:

a connection device configured to connect at least one of the printing mechanism and the sub-scanning conveying mechanism of the printing unit with a control part of the apparatus, wherein the connection device is exposed when the printing unit is accommodated in the apparatus and a side cover of the apparatus has been opened.

19. The image forming apparatus according to claim 18, wherein the connection device comprises:

a board fixed to the printing unit; and a first connector arranged on the board and configured to connect with the control part of the apparatus.

20. The image forming apparatus according to claim 19, wherein the connection device further comprises:

a second connector arranged on the board and configured to connect with at least one of the printing mechanism and the sub-scanning conveying mechanism of the printing unit; and a wiring pattern arranged on the board and configured to connect the second connector and the first connector.

21. The image forming apparatus according to claim 18, wherein the connection device further comprises:

a board fixed to the printing unit; and a connector arranged on the board and configured to connect at least one of the printing mechanism and the sub-scanning conveying mechanism of the printing unit with the control part of the apparatus.

22. The image forming apparatus according to claim 1, wherein the printing unit comprises:

a sub-scanning conveying mechanism configured to convey the recording medium in a sub-scanning direction at a part of the printing unit where an image is formed on the recording medium.

23. The image forming apparatus according to claim 22, wherein the sub-scanning conveying mechanism comprises:

a conveying roller;

a platen; and a drive source configured to drive the conveying roller.

24. The image forming apparatus according to claim 22, wherein the sub-scanning conveying mechanism comprises:

a conveying roller;

a conveying belt; and a drive source configured to drive at least either of the conveying roller and the conveying belt.

25. The image forming apparatus according to claim 24, wherein the conveying belt is an electrostatic belt.

26. The image forming apparatus according to claim 22, wherein the sub-scanning conveying mechanism comprises:

a control circuit configured to control conveying the recording medium in the sub-scanning direction.

27. The image forming apparatus according to claim 22, wherein the printing unit further comprises:

a connection device configured to connect the sub-scanning conveying mechanism of the printing unit and a control part of the apparatus, wherein the connection device is exposed when the printing unit is accommodated in the apparatus and a side cover of the apparatus has been opened.

28. The image forming apparatus according to claim 27, wherein the connection device comprises:

a board fixed to the printing unit; and a first connector arranged on the board and configured to connect with the control part of the apparatus.

29. The image forming apparatus according to claim 28, wherein the connection device further comprises:

a second connector arranged on the board and configured to connect with the sub-scanning conveying mechanism of the printing unit; and a wiring pattern arranged on the board and configured to connect the second connector and the first connector.

30. The image forming apparatus according to claim 27, wherein the connection device comprises:

a board fixed to the printing unit; and a connector arranged on the board and configured to connect the sub-scanning conveying mechanism and the control part of the apparatus.

31. The image forming apparatus according to claim 1, further comprising:

an ink tank configured to supply ink to the printing unit and to be moved integrally with the printing unit when the printing unit is moved.

32. The image forming apparatus according to claim 1, wherein the printing unit is configured to include a handhold.

33. The image forming apparatus according to claim 32, wherein the handhold comprises:

a belt-like member extending along a member of the printing unit with a tip end thereof detachably fastened to the member and configured such that the tip end thereof can be detached from the member and after the tip end thereof has been detached from the member and the belt-like member has been bent, can be fastened to another member of the printing unit so that the belt-like member can be grasped with fingers.

34. The image forming apparatus according to claim 1, further comprising:

an image reading part configured to optically read an original document and to convert image information of the original document to an electrical signal; and an image forming part configured to include the printing unit, wherein the image reading part is provided above the image forming part.

35. The image forming apparatus according to claim 34, further comprising:

a discharge tray onto which the recording medium on which an image has been formed is discharged, wherein the discharge tray is provided between the image reading part and the image forming part.

36. An image forming apparatus according to claim 1, wherein the maintenance mechanism is drawn from the front of the image forming apparatus.

37. An image forming apparatus according to claim 1, further comprising:

a trial ink ejection mechanism configured to execute trial ink ejection outside a printing area arranged in an outermost portion with respect to a direction of removal from the image forming apparatus.

38. An image forming apparatus according to claim 37, wherein said printing unit includes an opening extending in the carriage moving direction and configured to exposed at least one of the guide rod, the carriage, and the trial ink ejection mechanism.

39. An image forming apparatus according to claim 1, wherein said cleaner includes a wiper configured to wipe the ink jet head.

40. An image forming apparatus, comprising:

a printing unit including an ink jet printing head configured to eject ink onto a recording medium and a sheet conveying mechanism configured to convey a recording medium in a sub-scanning direction, the printing unit including a carriage having the ink jet printing head mounted thereto, the carriage moving along a guide member in a main direction perpendicular to a recording medium conveying direction, the printing unit further including a maintenance mechanism configured to maintain a writing function of the ink jet printing head, said maintenance mechanism including a cleaner configured to clean a surface of the ink jet printing head; and a guide member configured to guide the printing unit when the printing unit is drawn from the image forming apparatus, the guide member extending substantially perpendicular to the recording medium conveying direction and extending in a substantially horizontal direction, the guide member extending substantially perpendicular to the recording medium conveying direction;

wherein the sheet conveying mechanism is drawn together with the ink jet printing head, the inkjet printing head is located opposing the maintenance mechanism when the maintenance mechanism is drawn together with the inkjet printing head, and wherein the maintenance mechanism is drawn in the main direction and is arranged in an inner-most portion with respect to a direction of removal from the image forming apparatus.

41. An image forming apparatus according to claim 40, wherein the maintenance mechanism is drawn from the front of the image forming apparatus.

* * * * *